US007003928B2

(12) United States Patent
Patterson et al.

(10) Patent No.: US 7,003,928 B2
(45) Date of Patent: Feb. 28, 2006

(54) APPLIANCE FOR VACUUM SEALING FOOD CONTAINERS

(75) Inventors: Justin C. Patterson, Milford, MA (US); Salvatore R. Siano, North Attleboro, MA (US); Chi Kin John Mak, Hong Kong (CN); Heather Jones, Newton, MA (US); Francis E. Marino, Meredith, NH (US); Dave Bossa, Uxbridge, MA (US); Yigal Offir, Hopkinton, MA (US)

(73) Assignee: JCS/THG, LLC, Milford, MA (US)

( * ) Notice: Subject to any disclaimer, the term of this patent is extended or adjusted under 35 U.S.C. 154(b) by 209 days.

(21) Appl. No.: 10/371,610

(22) Filed: Feb. 21, 2003

(65) Prior Publication Data

US 2004/0065051 A1 Apr. 8, 2004

Related U.S. Application Data

(60) Provisional application No. 60/416,036, filed on Oct. 4, 2002.

(51) Int. Cl.
*B65B 31/00* (2006.01)

(52) U.S. Cl. ..... 53/405; 53/434; 53/512

(58) Field of Classification Search ..... 53/405, 53/427, 432, 434, 510, 512; 156/497, 583.8, 156/583.9

See application file for complete search history.

(56) References Cited

U.S. PATENT DOCUMENTS 29,582 A 8/1860 Gill
114,932 A 5/1871 Dubrul
222,917 A 12/1879 Leininger
303,014 A 8/1884 Hoyt (Continued)

FOREIGN PATENT DOCUMENTS

AU 568605 5/1984
AU 572877 2/1985

(Continued)

OTHER PUBLICATIONS

"Foodsaver, The First Commercial–Quality Vacuum Packaging System for the Home," Deanna DeLong, 1988.

"Foodsaver, The First Commercial–Quality Vacuum Packaging System for the Home," Deanna DeLong, 1987.

Magic Vac®Champion Commerical Quality Vacuum Sealer Model #1750 ©2000, Instruction Manual, Deni, pp. 1–15.

*Primary Examiner*—Louis Huynh
(74) *Attorney, Agent, or Firm*—Hoffman & Baron, LLP; Frank E. Marino

(57) ABSTRACT

A system for evacuating containers. The system includes a base housing defining a recess having a vacuum inlet port in communication with a vacuum source. An inner door is hinged to the base housing and is sized to cover the recess when in a closed position, and an outer door having a sealing member is hinged to close over the inner door. A vacuum nozzle extends at least partially between the inner and outer doors and is in communication with the recess. The inner and outer doors cooperate to retain a flexible container therebetween and around the nozzle so that the nozzle is positioned for fluid communication with an inside of the container. A removable drip pan is positioned to retain fluids drawn by the nozzle.

120 Claims, 16 Drawing Sheets

U.S. PATENT DOCUMENTS

| | | | |
|---|---|---|---|
| 523,757 | A | 7/1894 | Brooks |
| 578,410 | A | 3/1897 | Lord |
| 665,807 | A | 1/1901 | Starr |
| 746,038 | A | 12/1903 | Davis et al. |
| 947,882 | A | 2/1910 | Batchelder |
| 1,005,349 | A | 10/1911 | Staunton |
| 1,187,031 | A | 6/1916 | Black et al. |
| 1,250,210 | A | 12/1917 | Norwood et al. |
| 1,263,633 | A | 4/1918 | Zoelly |
| 1,293,547 | A | 2/1919 | Reese |
| 1,293,573 | A | 2/1919 | Swartz |
| 1,346,435 | A | 7/1920 | Worster |
| 1,470,548 | A | 10/1923 | Spohrer |
| 1,521,203 | A | 12/1924 | Roehrig |
| 1,542,931 | A | 6/1925 | Foote |
| 1,593,222 | A | 7/1926 | Russell |
| 1,598,590 | A | 8/1926 | Staunton |
| 1,601,705 | A | 9/1926 | Staunton |
| 1,615,772 | A | 1/1927 | Poole |
| 1,621,132 | A | 3/1927 | Reinbold |
| 1,722,284 | A | 7/1929 | Fisher |
| 1,761,036 | A | 6/1930 | Greenwald |
| 1,783,486 | A | 12/1930 | Volet |
| 1,786,486 | A | 12/1930 | Friede et al. |
| 1,793,163 | A | 2/1931 | Deubener |
| 1,917,760 | A | 7/1933 | Geiger |
| 1,938,451 | A | 12/1933 | Floyd et al. |
| 1,945,338 | A | 1/1934 | Terry |
| 1,955,958 | A | 4/1934 | Greenwald |
| 2,007,730 | A | 7/1935 | Terry |
| 2,069,154 | A | 1/1937 | Kruse |
| 2,069,156 | A | 1/1937 | Bernhardt |
| D103,076 | S | 2/1937 | Stallings |
| 2,092,445 | A | 9/1937 | Doulgheridis |
| 2,100,799 | A | 11/1937 | Drysdale |
| 2,112,289 | A | 3/1938 | Hirsche |
| 2,123,498 | A | 7/1938 | Buchanan |
| D114,858 | S | 5/1939 | Kamenstein |
| 2,157,624 | A | 5/1939 | Overmyer |
| 2,228,364 | A | 1/1941 | Philipp |
| 2,251,648 | A | 8/1941 | Wayman |
| 2,270,332 | A | 1/1942 | Osborn |
| 2,322,236 | A | 6/1943 | Ingram |
| 2,327,054 | A | 8/1943 | Mays |
| 2,349,588 | A | 5/1944 | Brand |
| 2,406,771 | A | 9/1946 | Hughes |
| 2,436,849 | A | 3/1948 | Billetter |
| 2,489,989 | A | 11/1949 | Totman |
| 2,499,061 | A | 2/1950 | Gray |
| 2,506,362 | A | 5/1950 | Hofmann |
| 2,538,920 | A | 1/1951 | Shumann |
| D162,579 | S | 3/1951 | Roop |
| 2,575,770 | A | 11/1951 | Roop |
| 2,583,583 | A | 1/1952 | Mangan |
| 2,592,992 | A | 4/1952 | Abercrombie |
| 2,606,704 | A | 8/1952 | Nichols |
| 2,653,729 | A | 9/1953 | Richter |
| 2,669,176 | A | 2/1954 | Lazerus |
| 2,672,268 | A | 3/1954 | Bower |
| RE23,910 | E | 12/1954 | Smith et al. |
| 2,714,557 | A | 8/1955 | Mahaffy |
| 2,732,988 | A | 1/1956 | Feinstein |
| 2,749,686 | A | 6/1956 | Lorenz et al. |
| 2,751,927 | A | 6/1956 | Kinney |
| 2,755,952 | A | 7/1956 | Ringen |
| 2,778,171 | A | 1/1957 | Taunton |
| 2,778,173 | A | 1/1957 | Taunton |
| 2,785,720 | A | 3/1957 | Wikle |
| 2,790,869 | A | 4/1957 | Hansen |
| 2,823,850 | A | 2/1958 | Hintze |
| 2,836,462 | A | 5/1958 | Wenner |
| 2,838,894 | A | 6/1958 | Paikens et al. |
| 2,870,954 | A | 1/1959 | Kulesza |
| 2,890,810 | A | 6/1959 | Rohling |
| 2,899,516 | A | 8/1959 | Smith |
| 2,921,159 | A | 1/1960 | Elderton et al. |
| 2,949,105 | A | 8/1960 | Davis |
| 2,956,723 | A | 10/1960 | Tritsch |
| 2,963,838 | A | 12/1960 | Harrison et al. |
| 2,991,609 | A | 7/1961 | Randall |
| 3,000,418 | A | 9/1961 | Bitting |
| 3,002,063 | A | 9/1961 | Giladett |
| D193,199 | S | 7/1962 | Ebstein |
| 3,047,186 | A | 7/1962 | Serio |
| 3,054,148 | A | 9/1962 | Zimmerli |
| 3,055,536 | A | 9/1962 | Dieny |
| 3,074,451 | A | 1/1963 | Whitney |
| 3,085,737 | A | 4/1963 | Horton |
| 3,104,293 | A | 9/1963 | Rendler |
| 3,137,746 | A | 6/1964 | Seymour et al. |
| 3,142,599 | A | 7/1964 | Chavannes |
| 3,144,814 | A | 8/1964 | Lokey |
| 3,157,805 | A | 11/1964 | Hoffmeyer et al. |
| 3,172,974 | A | 3/1965 | Perrino |
| 3,193,604 | A | 7/1965 | Mercer |
| 3,224,574 | A | 12/1965 | McConnell et al. |
| 3,233,727 | A | 2/1966 | Wilson |
| 3,234,072 | A | 2/1966 | Dreeben |
| 3,248,041 | A | 4/1966 | Burke |
| 3,255,567 | A | 6/1966 | Keslar et al. |
| 3,286,005 | A | 11/1966 | Cook |
| 3,296,395 | A | 1/1967 | Fraser |
| 3,304,687 | A | 2/1967 | Tomczak et al. |
| 3,311,517 | A | 3/1967 | Keslar et al. |
| 3,313,444 | A | 4/1967 | Katell |
| 3,320,097 | A | 5/1967 | Sugalski |
| 3,374,944 | A | 3/1968 | Scheldorf et al. |
| 3,376,690 | A | 4/1968 | Jianas |
| 3,393,861 | A | 7/1968 | Clayton et al. |
| D212,044 | S | 8/1968 | Woodman |
| 3,411,698 | A | 11/1968 | Reynolds |
| 3,458,966 | A | 8/1969 | Dunbar et al. |
| 3,466,212 | A | 9/1969 | Clayton et al. |
| 3,484,835 | A | 12/1969 | Trounstine et al. |
| 3,516,223 | A | 6/1970 | Andersen et al. |
| 3,520,472 | A | 7/1970 | Kukulski |
| 3,547,340 | A | 12/1970 | McDonald |
| 3,550,839 | A | 12/1970 | Clayton et al. |
| 3,570,337 | A | 3/1971 | Morgan |
| 3,587,794 | A | 6/1971 | Mattel |
| 3,589,098 | A | 6/1971 | Schainholz et al. |
| 3,592,244 | A | 7/1971 | Chamberlin |
| 3,599,017 | A | 8/1971 | Oakes |
| 3,625,058 | A | 12/1971 | Endress et al. |
| 3,630,665 | A | 12/1971 | Andersen et al. |
| 3,632,014 | A | 1/1972 | Basile |
| 3,635,380 | A | 1/1972 | Fitzgerald |
| 3,688,064 | A | 8/1972 | Myers |
| 3,688,463 | A | 9/1972 | Titchenal |
| 3,689,719 | A | 9/1972 | Phillips et al. |
| 3,699,742 | A | 10/1972 | Giraudi |
| 3,704,964 | A | 12/1972 | Phelps |
| 3,735,918 | A | 5/1973 | Tundermann |
| 3,738,565 | A | 6/1973 | Ackley et al. |
| 3,743,172 | A | 7/1973 | Ackley et al. |
| 3,744,384 | A | 7/1973 | Jarritt et al. |
| 3,746,607 | A | 7/1973 | Harmon et al. |
| 3,760,940 | A | 9/1973 | Bustin |
| 3,774,637 | A | 11/1973 | Weber et al. |
| 3,777,778 | A | 12/1973 | Janu |
| 3,800,503 | A | 4/1974 | Maki |

3,809,217 A 5/1974 Harrison
3,827,596 A 8/1974 Powers, Jr.
3,828,520 A 8/1974 Merritt
3,828,556 A 8/1974 Nolden
3,832,267 A 8/1974 Liu
3,832,824 A 9/1974 Burrell
3,848,411 A 11/1974 Strawn
3,851,437 A 12/1974 Waldrop et al.
3,857,144 A 12/1974 Bustin
3,858,750 A 1/1975 Grall
3,859,157 A 1/1975 Morgan
3,866,390 A 2/1975 Moreland, II et al.
3,867,226 A 2/1975 Guido et al.
3,904,465 A 9/1975 Haase et al.
D238,137 S 12/1975 Swett
3,928,938 A 12/1975 Burrell
3,931,806 A 1/1976 Hayes
3,933,065 A 1/1976 Janu et al.
3,953,819 A 4/1976 Keerie et al.
3,958,391 A 5/1976 Kujubu
3,958,693 A 5/1976 Greene
3,965,646 A 6/1976 Hawkins
3,968,897 A 7/1976 Rodgers
3,969,039 A 7/1976 Shoulders
3,973,063 A 8/1976 Clayton
3,984,047 A 10/1976 Clayton et al.
3,988,499 A 10/1976 Reynolds
4,015,635 A 4/1977 Göransson
4,016,999 A 4/1977 Denzer
4,021,290 A 5/1977 Smith
4,021,291 A 5/1977 Joice
4,024,692 A 5/1977 Young et al.
4,028,015 A 6/1977 Hetzel
4,051,971 A 10/1977 Saleri et al.
4,051,975 A 10/1977 Ohgida et al.
4,054,044 A 10/1977 Wareing et al.
4,055,672 A 10/1977 Hirsch et al.
4,059,113 A 11/1977 Beinsen et al.
4,076,121 A 2/1978 Clayton et al.
4,085,244 A 4/1978 Stillman
4,093,068 A 6/1978 Smrt
4,103,801 A 8/1978 Walker
4,104,404 A 8/1978 Bieler et al.
4,115,182 A 9/1978 Wildmoser
D250,871 S 1/1979 Taylor
4,132,048 A 1/1979 Day
4,132,594 A 1/1979 Bank et al.
4,143,787 A 3/1979 Walker
4,149,650 A 4/1979 Whelchel et al.
4,155,693 A 5/1979 Raley
4,156,741 A 5/1979 Beauvais et al.
4,157,237 A 6/1979 Raley
RE30,045 E 7/1979 Greene
4,164,111 A 8/1979 Di Bernardo
4,178,932 A 12/1979 Ryder et al.
4,179,862 A 12/1979 Landolt
4,188,254 A 2/1980 Hemperly, Jr.
4,188,968 A 2/1980 Trobaugh et al.
4,218,967 A 8/1980 Batchelor
4,220,684 A 9/1980 Olson
4,221,101 A 9/1980 Woods
4,222,276 A 9/1980 DeRogatis
4,239,111 A 12/1980 Conant et al.
4,251,976 A 2/1981 Zanni
4,258,747 A 3/1981 Trobaugh
4,259,285 A 3/1981 Baumgartl et al.
4,261,253 A 4/1981 Smith, II
4,261,509 A 4/1981 Anders et al.
4,268,383 A 5/1981 Trobaugh
4,278,114 A 7/1981 Ruberg
4,284,672 A 8/1981 Stillman
4,284,674 A 8/1981 Sheptak
4,285,441 A 8/1981 Ziskind
4,287,819 A 9/1981 Emerit
4,294,056 A 10/1981 Paulsen et al.
4,296,588 A 10/1981 Vetter
4,301,826 A 11/1981 Beckerer
4,315,963 A 2/1982 Havens
4,329,568 A 5/1982 Rocher et al.
4,330,975 A 5/1982 Kakiuchi
4,334,131 A 6/1982 Cooper et al.
4,351,192 A 9/1982 Toda et al.
4,355,494 A 10/1982 Tilman
4,372,096 A 2/1983 Baum
4,376,147 A 3/1983 Byrne et al.
4,378,266 A 3/1983 Gerken
4,401,256 A 8/1983 Krieg
4,405,667 A 9/1983 Christensen et al.
4,409,840 A 10/1983 Roberts
D271,555 S 11/1983 Daenen et al.
4,416,104 A 11/1983 Yamada
4,428,478 A 1/1984 Hoffman
4,445,550 A 5/1984 Davis et al.
4,449,243 A 5/1984 Platel
4,452,202 A 6/1984 Meyer
4,455,874 A 6/1984 Paros
4,456,639 A 6/1984 Drower et al.
4,470,153 A 9/1984 Kenan
4,471,599 A 9/1984 Mugnai
4,479,844 A 10/1984 Yamada
4,486,363 A 12/1984 Pricone et al.
4,488,439 A 12/1984 Gast et al.
4,491,217 A 1/1985 Weder et al.
4,492,533 A 1/1985 Tsuge
4,493,877 A 1/1985 Burnett
4,506,600 A 3/1985 Hersom et al.
4,518,643 A 5/1985 Francis
4,534,485 A 8/1985 Subramanian
4,534,984 A 8/1985 Kuehne
4,541,224 A 9/1985 Mugnai
4,545,177 A 10/1985 Day
4,546,029 A 10/1985 Cancio et al.
4,550,546 A 11/1985 Raley et al.
4,551,379 A 11/1985 Kerr
4,557,780 A 12/1985 Newsome et al.
4,560,143 A 12/1985 Robinson
4,561,925 A 12/1985 Skerjanec et al.
4,575,990 A 3/1986 von Bismarck
4,576,283 A 3/1986 Fafournoux
4,578,928 A 4/1986 Andre et al.
4,579,141 A 4/1986 Arff
4,579,147 A 4/1986 Davies et al.
4,579,756 A 4/1986 Edgel
4,581,764 A 4/1986 Plock et al.
4,583,347 A 4/1986 Nielsen
4,598,531 A 7/1986 Ruff et al.
4,598,741 A 7/1986 Johnson et al.
4,601,861 A 7/1986 Pricone et al.
4,625,565 A 12/1986 Wada et al.
4,627,798 A 12/1986 Thomas
D288,409 S 2/1987 Mikkelsen
4,640,081 A 2/1987 Kawaguchi et al.
4,647,483 A 3/1987 Tse et al.
4,648,277 A 3/1987 Obermann
4,657,540 A 4/1987 Iwamoto et al.
4,658,433 A 4/1987 Savicki
4,660,355 A 4/1987 Kristen
4,662,521 A 5/1987 Moretti
4,678,457 A 7/1987 Slobodkin
4,683,170 A 7/1987 Tse et al.
4,683,702 A 8/1987 Vis
4,684,025 A 8/1987 Copland et al.

4,691,836 A 9/1987 Wassilieff
4,698,052 A 10/1987 Slobodkin
4,702,376 A 10/1987 Pagliaro
4,709,400 A 11/1987 Bruno
4,713,131 A 12/1987 Obeda
4,725,700 A 2/1988 Zolundow
4,729,476 A 3/1988 Lulham et al.
4,733,040 A 3/1988 Pelloni et al.
4,739,664 A 4/1988 Hetrick
4,744,936 A 5/1988 Bittner, Jr.
4,751,603 A 6/1988 Kwan
4,756,140 A 7/1988 Gannon
4,756,422 A 7/1988 Kristen
4,757,720 A 7/1988 Tanaka
D297,307 S 8/1988 Gerber
4,765,125 A 8/1988 Fafournoux
4,778,956 A 10/1988 Betterton et al.
4,790,454 A 12/1988 Clark et al.
4,795,665 A 1/1989 Lancaster et al.
4,810,451 A 3/1989 Ermert et al.
4,835,037 A 5/1989 Beer
4,836,755 A 6/1989 Nitsche et al.
4,845,927 A 7/1989 Rapparini
4,859,519 A 8/1989 Cabe, Jr. et al.
4,860,147 A 8/1989 Fai
4,860,523 A 8/1989 Teteishi et al.
4,869,725 A 9/1989 Schneider et al.
D305,715 S 1/1990 Bruno
4,892,985 A 1/1990 Tateishi
4,903,459 A 2/1990 Okinaka
4,909,014 A 3/1990 Kobayashi et al.
4,909,276 A 3/1990 Bayly et al.
4,912,907 A 4/1990 Fang et al.
4,922,686 A 5/1990 Segota
4,928,829 A 5/1990 Di Bernardo
D309,419 S 7/1990 Berg
4,939,151 A 7/1990 Bacehowski et al.
4,941,310 A 7/1990 Kristen
4,945,344 A 7/1990 Farrell et al.
4,949,529 A 8/1990 Davis
4,963,419 A 10/1990 Lustig et al.
4,974,632 A 12/1990 Ericson
4,975,028 A 12/1990 Schultz
4,984,611 A 1/1991 Takatsuki et al.
4,989,745 A 2/1991 Schneider
4,996,848 A 3/1991 Nelson et al.
5,024,799 A 6/1991 Harp et al.
5,035,103 A 7/1991 Akkala
5,041,148 A 8/1991 Gereby et al.
5,048,269 A 9/1991 Deni
5,056,292 A 10/1991 Natterer
5,061,331 A 10/1991 Gute
5,063,781 A 11/1991 Conforti et al.
5,071,667 A 12/1991 Grüne et al.
5,075,143 A 12/1991 Bekele
D326,391 S 5/1992 Verchere
5,120,951 A 6/1992 Small
5,121,590 A 6/1992 Scanlan
5,134,001 A 7/1992 Osgood
5,168,192 A 12/1992 Kosugi et al.
5,177,931 A 1/1993 Latter
5,177,937 A 1/1993 Alden
5,182,069 A 1/1993 Wick
5,195,427 A 3/1993 Germano
5,202,192 A 4/1993 Hope et al.
5,203,465 A 4/1993 Baumgarten
5,215,445 A 6/1993 Chen
5,228,274 A 7/1993 De Man et al.
5,230,430 A 7/1993 Kidder
5,232,016 A 8/1993 Chun
5,234,731 A 8/1993 Ferguson
5,237,867 A 8/1993 Cook, Jr.
5,239,808 A 8/1993 Wells et al.
5,243,858 A 9/1993 Erskine et al.
5,258,191 A 11/1993 Hayes
5,259,904 A 11/1993 Ausnit
5,275,679 A 1/1994 Rojek
5,277,326 A 1/1994 Chiba
5,279,439 A 1/1994 Kasugai et al.
5,287,680 A 2/1994 Lau
5,297,939 A 3/1994 Orth et al.
5,315,807 A 5/1994 Restle et al.
5,333,736 A 8/1994 Kawamura
5,338,166 A 8/1994 Schultz
5,347,918 A 9/1994 Chen
5,352,323 A 10/1994 Chi
5,364,241 A 11/1994 Schultz
5,375,275 A 12/1994 Sanders
5,390,809 A 2/1995 Lin
5,396,751 A 3/1995 Chi
5,398,811 A 3/1995 Latella, Jr.
5,400,568 A 3/1995 Kanemitsu et al.
5,405,038 A 4/1995 Chuang
5,406,776 A 4/1995 Cappi et al.
RE34,929 E 5/1995 Kristen
5,435,943 A 7/1995 Adams et al.
5,439,724 A 8/1995 Rojek
5,449,079 A 9/1995 Yang
5,465,857 A 11/1995 Yang
5,469,979 A 11/1995 Chiou
5,499,735 A 3/1996 Chen
5,509,790 A 4/1996 Schuderi et al.
5,513,480 A 5/1996 Tsoi
5,515,714 A 5/1996 Sultan et al.
D371,053 S 6/1996 Lillelund et al.
5,533,622 A 7/1996 Stockley, III et al.
5,540,347 A 7/1996 Griffin
5,549,035 A 8/1996 Wing-Chung
5,549,944 A 8/1996 Abate
5,551,213 A 9/1996 Koelsch et al.
5,554,093 A 9/1996 Porchia et al.
5,554,423 A 9/1996 Abate
5,558,243 A 9/1996 Chu
5,562,423 A 10/1996 Orth et al.
5,564,480 A 10/1996 Chen
5,564,581 A 10/1996 Lin
5,570,628 A 11/1996 Kiener et al.
5,597,086 A 1/1997 King-Shui
5,611,376 A 3/1997 Chuang
5,617,893 A 4/1997 Webster
5,618,111 A 4/1997 Porchia et al.
5,620,098 A 4/1997 Boos et al.
5,632,403 A 5/1997 Deng
5,638,664 A 6/1997 Levsen et al.
5,651,470 A 7/1997 Wu
5,655,357 A 8/1997 Kristen
5,667,627 A 9/1997 Plangetis
5,682,727 A 11/1997 Harte et al.
5,692,632 A 12/1997 Hsieh et al.
5,697,510 A 12/1997 Wang et al.
5,698,250 A 12/1997 DelDuca et al.
5,711,136 A 1/1998 Carcano
5,715,743 A 2/1998 Goddard
5,735,317 A 4/1998 Wu
5,737,906 A 4/1998 Ishimaru
5,748,862 A 5/1998 Ohno et al.
5,765,608 A 6/1998 Kristen
5,772,565 A 6/1998 Weyandt
D396,172 S 7/1998 Nask et al.
5,779,082 A 7/1998 Miramon
5,779,100 A 7/1998 Johnson
5,783,266 A 7/1998 Gehrke

| | | | |
|---|---|---|---|
| 5,784,862 | A | 7/1998 | Germano |
| 5,803,282 | A | 9/1998 | Chen et al. |
| 5,806,704 | A | 9/1998 | Jamison |
| 5,822,956 | A | 10/1998 | Liechti et al. |
| 5,833,090 | A | 11/1998 | Rojek |
| 5,858,164 | A | 1/1999 | Panjwani et al. |
| 5,863,378 | A | 1/1999 | Panjwani et al. |
| 5,869,000 | A | 2/1999 | DeCato |
| 5,874,155 | A | 2/1999 | Gehrke et al. |
| 5,888,648 | A | 3/1999 | Donovan et al. |
| 5,893,822 | A | 4/1999 | Deni et al. |
| 5,928,560 | A | 7/1999 | DelDuca et al. |
| 5,941,391 | A | 8/1999 | Jury |
| 5,944,212 | A | 8/1999 | Chang |
| 5,955,127 | A | 9/1999 | Glaser |
| 5,957,317 | A | 9/1999 | Lee |
| 5,964,255 | A | 10/1999 | Schmidt |
| 5,974,686 | A | 11/1999 | Nomura et al. |
| 5,992,666 | A | 11/1999 | Wu |
| 6,007,308 | A | 12/1999 | Ko |
| 6,012,265 | A | 1/2000 | Ady |
| 6,014,986 | A | 1/2000 | Baumgarten |
| 6,017,195 | A | 1/2000 | Skaggs |
| 6,035,769 | A | 3/2000 | Nomura et al. |
| 6,044,756 | A | 4/2000 | Chang |
| 6,047,522 | A | 4/2000 | Huang |
| 6,054,153 | A | 4/2000 | Carr et al. |
| 6,058,681 | A | 5/2000 | Recchia, Jr. |
| 6,058,998 | A | 5/2000 | Kristen |
| 6,068,933 | A | 5/2000 | Shepard et al. |
| RE36,734 | E | 6/2000 | Binder et al. |
| 6,083,587 | A | 7/2000 | Smith et al. |
| 6,099,266 | A | 8/2000 | Johnson et al. |
| 6,120,860 | A | 9/2000 | Bowen et al. |
| 6,125,613 | A | 10/2000 | Eberhardt, Jr. et al. |
| 6,129,007 | A | 10/2000 | Chan et al. |
| 6,131,753 | A | 10/2000 | Lynch |
| 6,140,621 | A | 10/2000 | Ho et al. |
| 6,157,110 | A | 12/2000 | Strobl |
| 6,161,716 | A | 12/2000 | Oberhofer et al. |
| 6,170,985 | B1 | 1/2001 | Shabram, Jr. et al. |
| 6,176,026 | B1 | 1/2001 | Leung |
| 6,193,475 | B1 | 2/2001 | Rozek |
| 6,256,968 | B1 | 7/2001 | Kristen |
| 6,286,415 | B1 | 9/2001 | Leung |
| 6,289,796 | B1 | 9/2001 | Fung |
| 6,311,804 | B1 | 11/2001 | Baalmann et al. |
| 6,357,342 | B1 | 3/2002 | Leung |
| 6,361,843 | B1 | 3/2002 | Smith et al. |
| 6,374,725 | B1 | 4/2002 | Leung |
| 6,375,024 | B1 | 4/2002 | Park |
| 6,382,084 | B1 | 5/2002 | Chan et al. |
| 6,467,242 | B1 | 10/2002 | Huang |
| 6,619,493 | B1 | 9/2003 | Yang |
| 6,694,710 | B1 | 2/2004 | Wang |
| 6,789,690 | B1 | 9/2004 | Nieh et al. |
| 2001/0034999 | A1 | 11/2001 | Xiong et al. |
| 2003/0000180 | A1 | 1/2003 | Singer |
| 2003/0140603 | A1 | 7/2003 | Krasenics et al. |
| 2004/0031245 | A1 | 2/2004 | Kingeter et al. |
| 2005/0011166 | A1 | 1/2005 | Germano |
| 2005/0022473 | A1 | 2/2005 | Small et al. |
| 2005/0022474 | A1 | 2/2005 | Albritton et al. |
| 2005/0028494 | A1 | 2/2005 | Higer et al. |
| 2005/0039420 | A1 | 2/2005 | Albritton et al. |
| 2005/0050855 | A1 | 3/2005 | Baptista |
| 2005/0050856 | A1 | 3/2005 | Baptista |

FOREIGN PATENT DOCUMENTS

| | | | |
|---|---|---|---|
| AU | 588583 | | 10/1986 |
| AU | 585611 | | 11/1986 |
| AU | 593275 | | 3/1987 |
| AU | 581163 | | 8/1987 |
| AU | 584490 | | 8/1987 |
| AU | 593402 | | 5/1988 |
| AU | 632765 | | 4/1990 |
| AU | 621930 | | 6/1990 |
| AU | 630045 | | 11/1990 |
| AU | 638595 | | 2/1992 |
| AU | 663980 | | 6/1994 |
| AU | 716697 | | 4/1998 |
| AU | 750789 | | 8/1999 |
| AU | 749585 | | 10/1999 |
| AU | 750164 | | 3/2000 |
| CA | 806005 | | 2/1969 |
| CA | 897921 | | 4/1972 |
| CA | 981636 | | 1/1976 |
| CA | 1027723 | | 3/1978 |
| CA | 1052968 | | 4/1979 |
| CA | 1125980 | | 6/1982 |
| CA | 1126462 | | 6/1982 |
| CA | 1269958 | | 6/1990 |
| CA | 2018390 | | 1/1991 |
| CA | 2075940 | | 8/1991 |
| CA | 2016927 | | 11/1991 |
| DE | 69526 | | 3/1892 |
| DE | 1 761 403 | | 7/1971 |
| DE | 23 32 927 | C2 | 1/1974 |
| DE | 24 21 433 | A1 | 11/1975 |
| DE | 27 13 896 | C2 | 10/1977 |
| DE | 28 41 017 | A1 | 4/1979 |
| DE | 27 52 183 | C2 | 6/1979 |
| DE | 32 03 951 | A1 | 8/1983 |
| DE | 33 12 780 | A1 | 10/1984 |
| DE | 34 03 534 | A1 | 8/1985 |
| DE | 37 20 743 | A1 | 1/1988 |
| DE | 3632723 | | 3/1988 |
| DE | 88 15 329 | | 3/1989 |
| DE | 3834524 | A1 | 5/1989 |
| EP | 0 041 225 | A1 | 12/1981 |
| EP | 0 069 526 | A1 | 1/1983 |
| EP | 0 089 680 | B1 | 7/1989 |
| EP | 0 648 688 | B1 | 4/1995 |
| EP | 0 723 915 | A1 | 7/1996 |
| EP | 0 839 107 | B1 | 5/1998 |
| EP | 1 149 768 | A1 | 10/2001 |
| EP | 1149768 | | 10/2001 |
| EP | 1 326 488 | A2 | 7/2003 |
| EP | 1 403 185 | A1 | 3/2004 |
| EP | 1 433 719 | A1 | 6/2004 |
| FR | 873847 | | 7/1942 |
| FR | 1260772 | | 4/1961 |
| GB | 1 044 068 | | 9/1966 |
| GB | 1 363 721 | | 8/1974 |
| GB | 1 368 634 | | 10/1974 |
| GB | 1 370 355 | | 10/1974 |
| GB | 2 005 628 | A | 4/1979 |
| GB | 2 028 716 | A | 3/1980 |
| GB | 2 047 616 | A | 12/1980 |
| GB | 2 084 924 | A | 4/1982 |
| GB | 2 141 188 | A | 12/1984 |
| GB | 2 211 161 | A | 6/1989 |
| IT | 1 278 835 | | 11/1997 |
| JP | 54-38959 | A | 3/1979 |
| JP | 56-13362 | | 2/1981 |
| JP | 56-90392 | | 7/1981 |
| JP | 561-129705 | | 8/1986 |
| JP | 62-25607 | | 2/1987 |
| JP | 62-135126 | | 6/1987 |
| JP | 62-287823 | | 12/1987 |
| JP | 562287823 | | 12/1987 |
| JP | 63-7607 | | 1/1988 |

| | | |
|---|---|---|
| JP | 63-19224 | 1/1988 |
| JP | 63-55024 | 3/1988 |
| JP | 56379307 | 5/1988 |
| JP | 63-126208 | 8/1988 |
| JP | 63-307023 | 12/1988 |
| JP | 64-40318 | 2/1989 |
| JP | 1-124519 | 5/1989 |
| JP | 402-69806 | 5/1990 |
| JP | 404-87928 | 3/1992 |
| JP | 4-267749 | 9/1992 |
| JP | 405-178324 | 7/1993 |
| JP | 407-61419 | 3/1995 |
| JP | 62-13806 | 1/1997 |
| JP | 2000-043818 | 2/2000 |
| JP | A-2002-308215 | 10/2002 |
| JP | 2002308215 | 10/2002 |
| WO | WO 90/14998 | 12/1990 |
| WO | WO 96/34801 | 11/1996 |
| WO | WO 97/17259 | 5/1997 |
| WO | WO 00/26088 | 5/2000 |
| WO | WO 00/61437 | 10/2000 |
| WO | WO 01/53586 A1 | 7/2001 |
| WO | WO 01/62602 A2 | 8/2001 |
| WO | WO 01/64522 A1 | 9/2001 |
| WO | WO 01/98149 A1 | 12/2001 |
| WO | WO 02/10017 A1 | 2/2002 |
| WO | WO 03/064261 | 8/2003 |
| WO | WO 03/074363 A1 | 9/2003 |
| WO | WO 2004/048203 A1 | 6/2004 |
| WO | WO 2004/065222 A1 | 8/2004 |

APPLIANCE FOR VACUUM SEALING FOOD CONTAINERS

This application claims the benefit of the filing date under 35 U.S.C. §119(e) of Provisional U.S. application Ser. No. 60/416,036, filed on Oct. 4, 2002, which is hereby incorporated by reference in its entirety.

FIELD OF INVENTION

This invention relates to packaging systems. More specifically, this invention relates to an appliance for vacuum sealing various types of containers.

BACKGROUND OF THE INVENTION

Vacuum sealing appliances are used domestically and commercially to evacuate air from various containers such as plastic bags, reusable rigid plastic containers, or mason jars. These containers are often used for storing food. Vacuum sealing food packaging provides many benefits with a particular advantage of preserving the freshness and nutrients of food for a longer period of time than if food is stored while exposed to ambient air.

Typically, these appliances operate by receiving a bag, isolating the interior of the bag from ambient air, and drawing air from the interior of the bag before sealing it. One such appliance is a "Seal-A-Meal" product marketed by the Rival Company since at least 1982. This device utilized a simple nozzle to evacuate air from bags, while a single sealing door operated in conjunction with a heat-sealer to seal the bag closed. Other appliances have also been available to evacuate rigid containers such as jars.

A problem with many of these appliances is that as air is being removed from the bag or other suitable container, liquids or other particles in the container may be ingested into the vacuum source of the appliance. Ingesting liquids or other particles into the vacuum source, which is typically an electric device, may damage the vacuum source, creating less efficient drawing power or a breakdown. This is especially a problem when evacuating air from flexible containers containing liquidous food. It is therefore desirable to have a system that prevents liquids or excess particles from being ingested into the vacuum source and that is more easily cleaned.

Another problem with many of these appliances is a lack of sufficient vacuum pressure within the appliance. Prior art systems have lacked a vacuum source with enough power to draw a significant amount of air from a container.

An additional problem with many appliances is the inability to seal a container independently from the vacuuming process. A user may want to seal a container without evacuating air from the container, or a user may wish to seal a container that is not isolated from ambient air.

BRIEF SUMMARY OF THE INVENTION

The above shortcomings and others are addressed in one or more preferred embodiments of the invention described herein. In one aspect of the invention, a system for evacuating containers is provided comprising a base housing and a recess defined within the base housing. A vacuum inlet port is within the recess and is in communication with a vacuum source located within the base housing. An inner door is hinged to the base housing and sized to cover the recess when in a closed position. An outer door having a heat sealing means mounted thereon is hinged to close over the inner door. A vacuum nozzle extends at least partially between the inner and outer doors and is in communication with the recess. The inner and outer doors cooperate to retain a flexible container therebetween and around the nozzle so that the nozzle is positioned for fluid communication with an inside of the container.

In another aspect of the invention, an apparatus for sealing a plastic bag is provided. The apparatus comprises a base housing, a vacuum source mounted within the housing and a removable drip pan resting in the base and in communication with the vacuum source. A nozzle extends at least partially over the pan in communication with the vacuum source. A pair of doors is hingeably mounted to the base housing surrounding the nozzle for engaging the bag when an opening of the bag is positioned around the nozzle. A heating element mounted on one of the doors for heat-sealing the bag.

In yet another aspect of the invention, an evacuable lid and container combination is provided for use with the appliance and/or system of the present invention. The lid and container combination comprises a container having an open mouth and a lid adapted to cover the open mouth to define an enclosable chamber. The lid defines a central recess, and at least one central recess passageway located within the central recess able to sustain an air flow from an upper side of the canister lid to a lower side of the canister lid. A piston assembly is mounted for reciprocal movement within the central recess, with at least one piston passageway defined within the piston assembly capable of sustaining air flow through the piston assembly. A piston pipe is configured to retain the piston within the central recess, and a knob is configured to rotate the piston assembly via the piston pipe to align the at least one central recess passageway and the at least one piston passageway.

Various other aspects of the present invention are described and claimed herein.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

BRIEF DESCRIPTION OF SEVERAL VIEWS OF THE DRAWINGS

FIG. 6*a* is an enlarged perspective view of a portion of the drip pan;

DETAILED DESCRIPTION OF THE INVENTION

Figure 1:
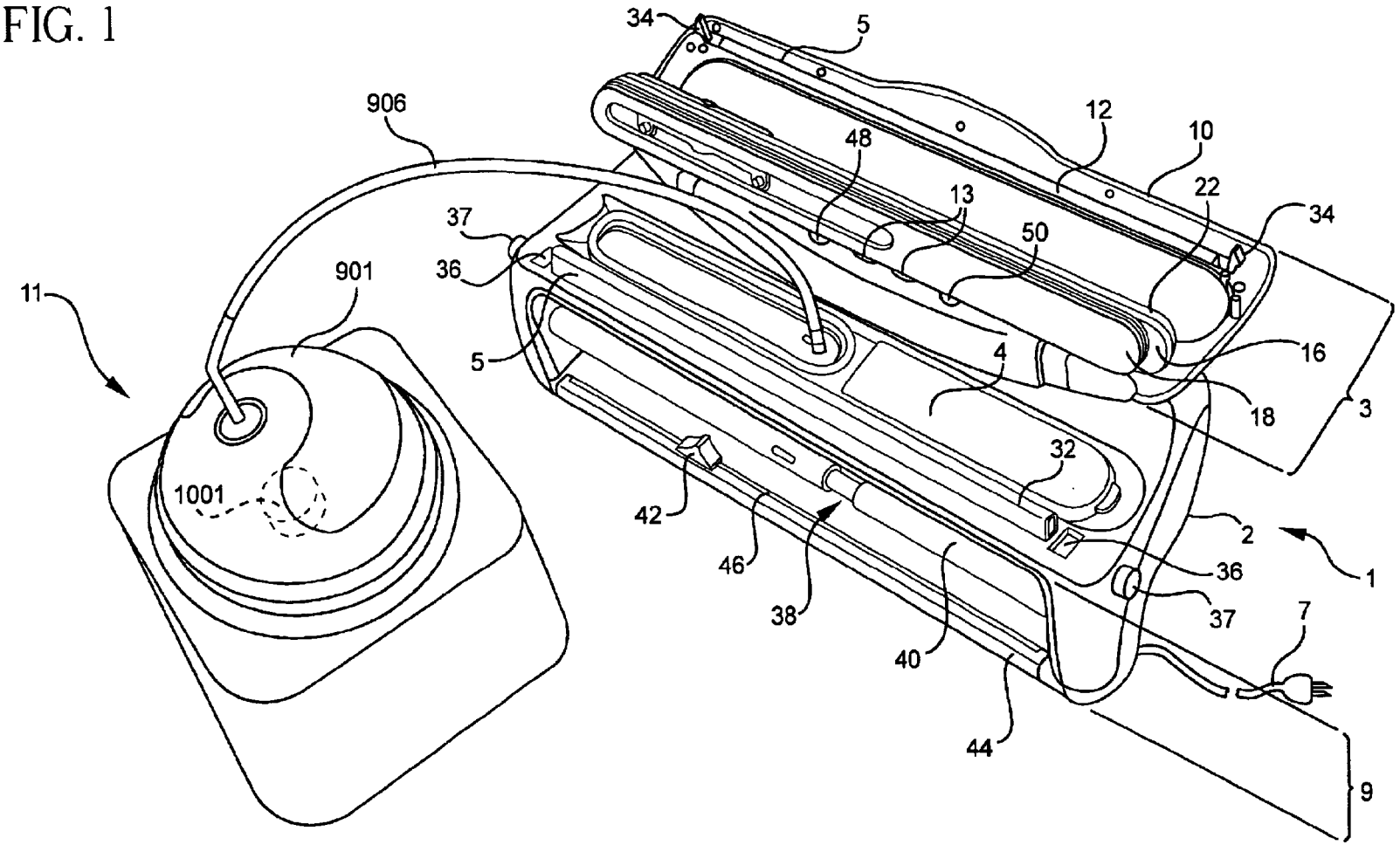
FIG. 1 is a perspective view of a vacuum sealing system in accordance with the present invention.

As shown in FIG. 1, this invention relates to a system for vacuum packaging or vacuum sealing containers. The basic components of the system are a vacuum sealing appliance 1, an adaptor 901, and canister lids implementing a canister lid valve assembly 1001. As shown in FIG. 2*b*, the vacuum sealing appliance 1 contains a vacuum source 15 and a control system 17 for the system implementing a pump 301 and a pressure sensor 501. As shown in FIG. 1, the vacuum sealing appliance 1 uses the vacuum source 15 to extract air from plastic bags and the adaptor 901 uses the vacuum source 15 to extract air from separate rigid containers such as mason jars or canisters using a canister lid valve assembly 1001.

Figure 2:
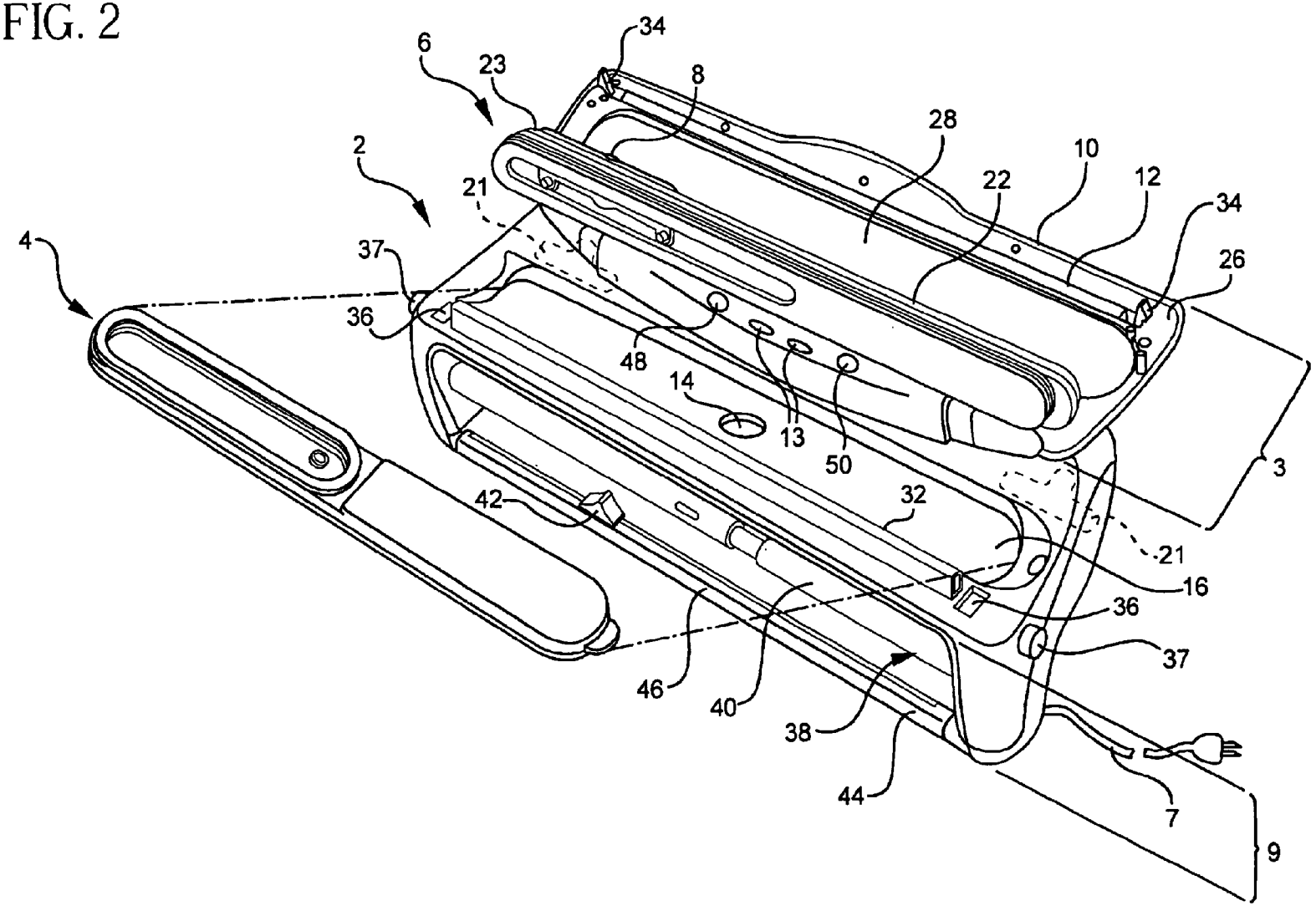
FIG. 2 is a perspective view of a vacuum sealing appliance in accordance with the present invention.
Figure 2B:
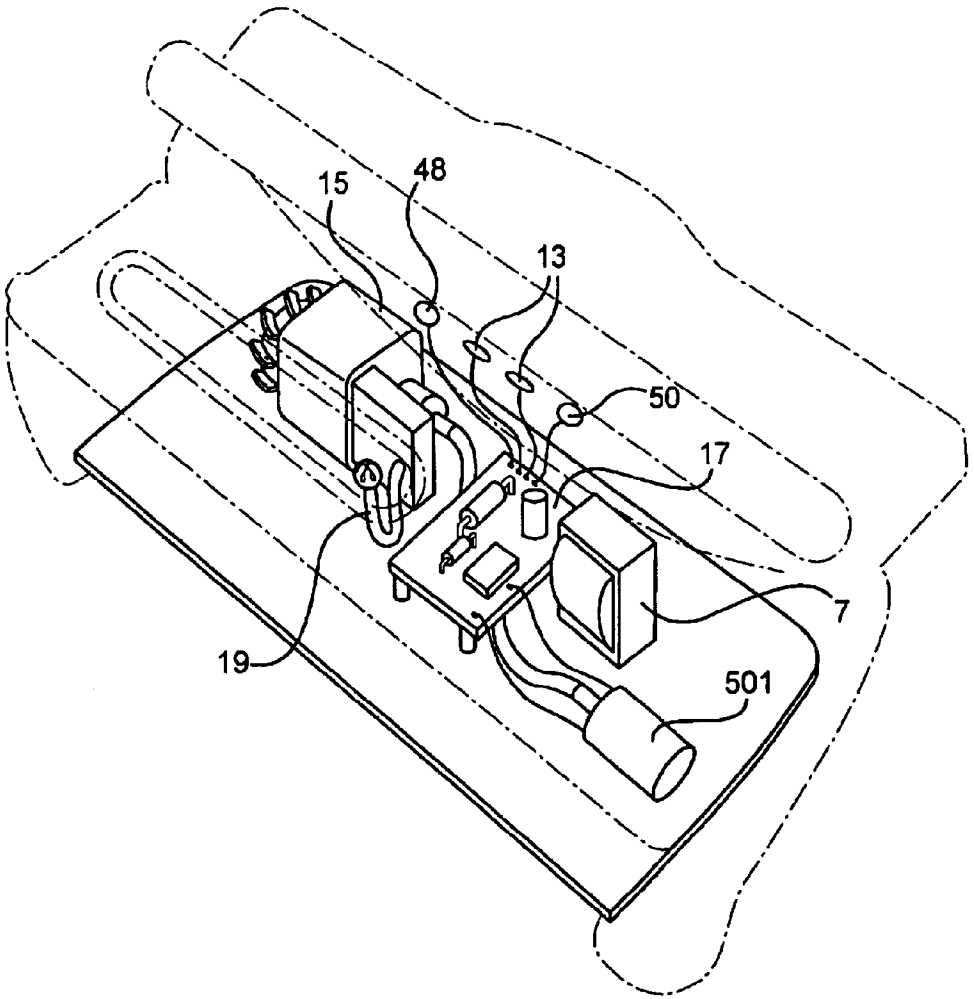
FIG. 2*b* is a perspective view showing the interior of the base housing.

The vacuum sealing appliance 1, shown in FIG. 2, generally consists of a base housing 2; a bag-engaging assembly 3 having a pair of clamping doors; a sealing assembly 5; a power assembly 7; a plastic bag roll and cutting assembly 9; a status display 13; and a wall mounting assembly 21 for mounting the base housing 2 to a wall. As shown in FIG. 2*b*, the base housing 2 is designed to contain a vacuum source 15, a control system 17, and the status display 13 for the entire vacuum sealing system, which is powered by the power assembly 7. As shown in FIG. 2, the power assembly 7 consists of an AC power cord leading from the base housing 2 and is connectable to an AC outlet.

The status display 13 is a series of lights on the base housing 2 that illuminate to indicate the current status of the vacuum sealing appliance 1. Preferably, the status display includes a light to indicate the vacuum source 15 is operating and a light to indicate that the sealing assembly 5 is operating.

The bag-engaging assembly 3 is mounted to the base housing 2 such that when the bag-engaging assembly 3 engages a plastic bag obtained from the plastic bag roll and cutting assembly 9, the vacuum source within the base housing 2 is in communication with the interior of the plastic bag to efficiently draw air from the interior of the plastic bag. Additionally, the sealing assembly 5 is partially mounted on the bag-engaging assembly 3 to form a seal in the plastic bag being evacuated.

As shown in FIG. 1, a remote canister adaptor assembly 11 is designed to communicate with the base housing 2 via hollow tubing 906 to evacuate air from a rigid container. The vacuum source within the base housing 2 may be used to create a vacuum within the rigid container. Once the adaptor 901 of the remote canister assembly 11 is removed, the canister lid valve assembly 1001 may be used to seal the interior of certain rigid containers from ambient air.

The base housing 2, as shown in FIG. 2*b*, contains a vacuum source 15, a control system 17 implementing a pressure sensor 501, and tubing 19. The vacuum source 15, pressure sensor 501, and exterior of the base housing 2 are in fluid communication via the tubing 19 such that the vacuum source draws air from the exterior of the base housing 2 and directs the flow of air to the pressure sensor 501. The pressure sensor 501 is triggered when the airflow is above a predetermined level. When the pressure sensor 501 is triggered, the control system 17 controls the vacuum source 15 and the sealing assembly 9.

Figure 4:
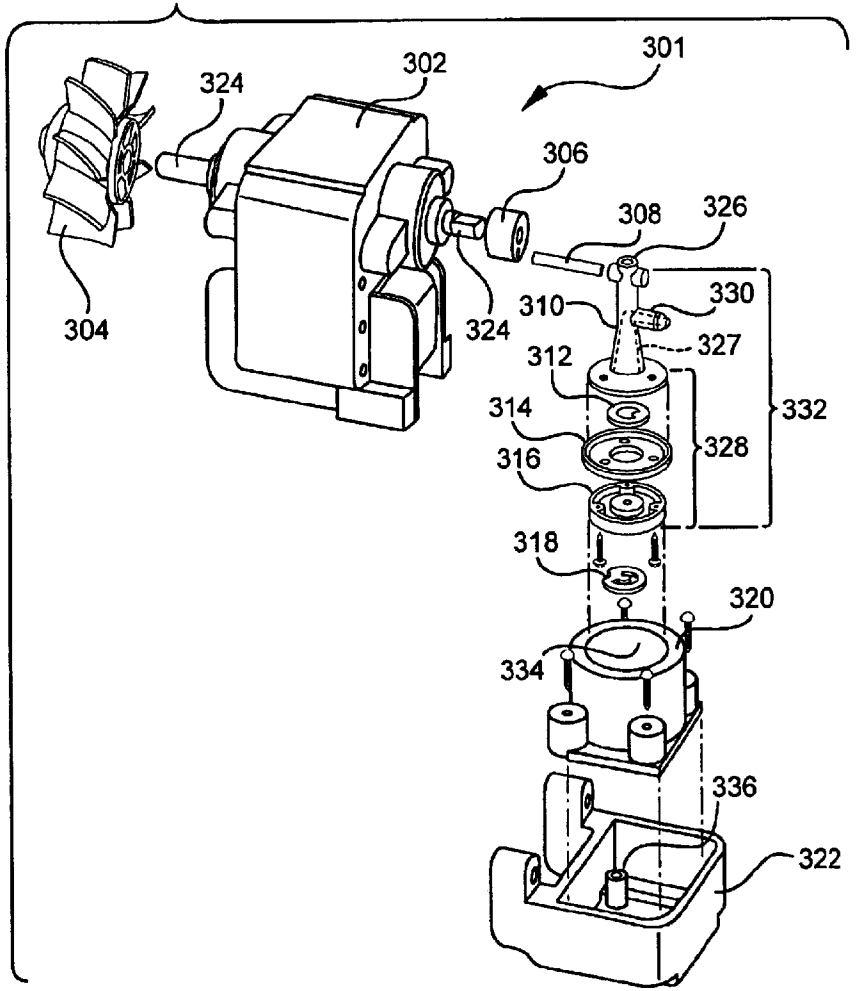
FIG. 4 is an exploded view of the pump motor.
Figure 3:
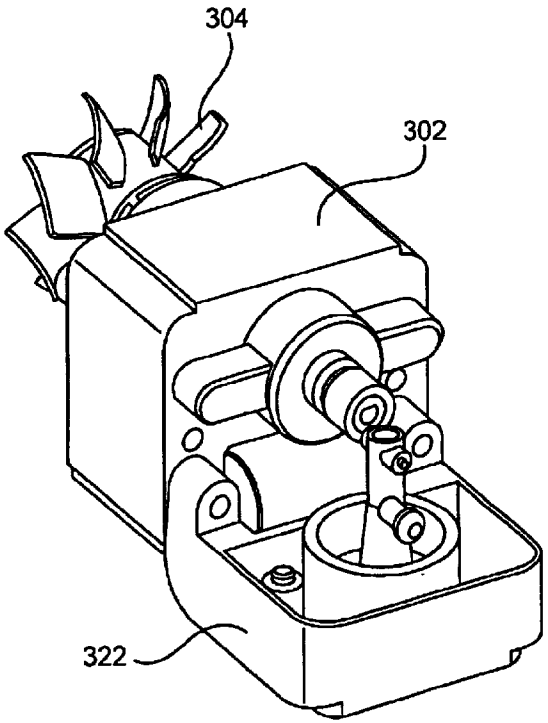
FIG. 3 is a perspective view of a pump motor used as a vacuum source within the vacuum sealing appliance.

The vacuum source 15 located within the base housing 2 is preferably a vacuum pump such as the pump 301 shown in FIGS. 3 and 4, but many types of pumps can effectively be used as a vacuum source 15. The pump 301 shown in FIGS. 3 and 4 generally consists of an electric motor 302, a motor shaft 324, a motor fan blade 304, a motor eccentric wheel 306, a motor eccentric shaft 308, a pump piston rod 310, a pump piston air brake 312, a pump piston ring 314, a pump piston lock 316, a pump cavity air brake 318, a pump cylinder 320, and a pump cavity body 322.

The pump cylinder 320 attaches to the pump cavity body 322 to define a cavity chamber 334 having a slightly larger diameter than a lower portion of the pump piston rod 328. The cavity chamber 334 is designed to form seal between the pump piston rod 310 and the walls of the cavity chamber 334 and to guide the movement of the lower portion of the pump piston rod 328 as the pump piston rod head 326 moves in a circular direction during the circular rotation of the motor eccentric wheel 306.

When the vacuum pump 301 is activated, the electric motor 302 turns the motor fan blade 304 and the motor eccentric wheel 306 via the motor shaft 324, which extends out a first side 325 and a second side 327 of the electric motor 302. The motor fan blade 304 is connected to the first side 325 of the motor shaft 324 and the motor eccentric wheel 306 is connected to the second side 327 of the motor shaft 324.

The motor eccentric shaft 308 preferably extends from the motor eccentric wheel 306. The pump piston rod 310 is pivotally connected to the motor eccentric shaft 308 to allow a pump piston rod head 326 to move upwardly and downwardly within the pump cylinder 320, thus drawing air into the cavity chamber 334 and pushing air out of the cavity chamber 334 and into tubing 19 leading to the pressure sensor 501. To gate the airflow, the pump piston rod 310 itself defines a piston passageway 327 that incorporates valve assemblies to allow air to pass between a lower intake of the pump piston rod 328 and a side output of the pump piston rod 330.

At the lower portion of the pump piston rod 328, the pump piston rod 310 is in communication with the pump piston air brake 312, the pump piston ring 314, and the pump piston lock 316. The pump piston air brake 312 is specifically in communication with the piston passageway 327, allowing air to enter the piston passageway 327 at the lower portion of the pump piston rod 328, but preventing air flow in the opposite direction, from the piston passageway 327 to outside the lower portion of the pump piston rod 328.

The pump piston ring 314 consists of a rubber elastomeric material extending a sufficient distance from the lower portion of the pump piston rod 328 to allow the pump piston ring 314 to engage the walls of the cavity chamber 334 and form a seal. The pump piston lock 316 covers the pump piston ring 314 and pump piston air brake 312, and attaches to the pump piston rod 310 to hold the pump piston ring 314 and pump piston air brake 312 in place during movement of the pump piston rod 310.

An air inlet 336 is in communication with the cavity chamber 334 of the pump cylinder 320 to allow air to flow into the cavity chamber 324 at a lower side of the pump cavity body 322. The air inlet 336 is covered by the pump cavity air brake 318, which is positioned within the cavity chamber 334. The pump cavity air brake 318 allows air to flow into the pump cylinder 320 at the air inlet 336, but prevents air to flow in the opposite direction, from the pump cylinder 320 to the air inlet 336.

Figure 5A:
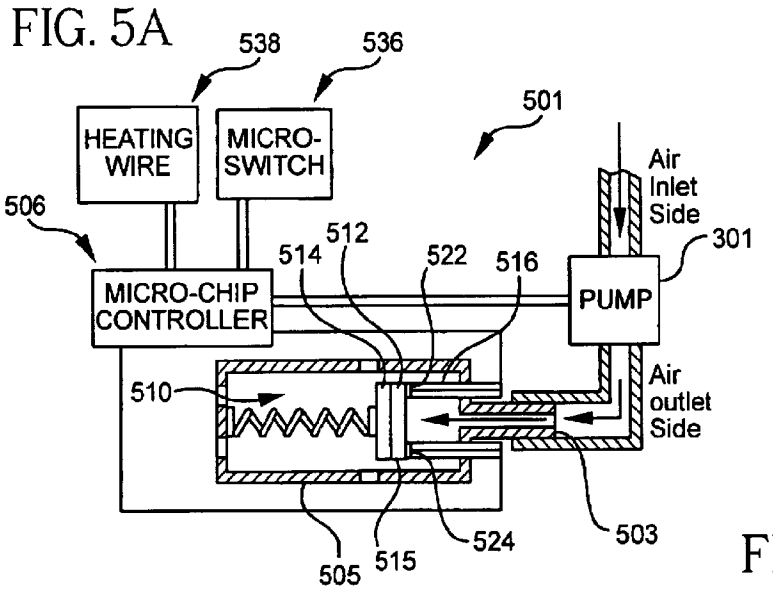
FIG. 5*a* is a schematic view of a pressure sensor used within the vacuum sealing appliance in a first position.
Figure 5B:
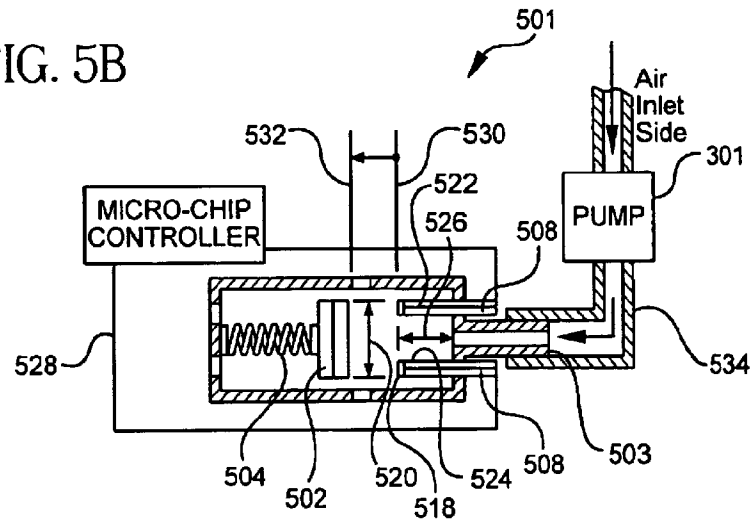
FIG. 5*b* is a schematic view of a pressure sensor used within the vacuum sealing appliance in a second position.

Air evacuated by the pump 301 is directed towards the pressure sensor 501, which is shown in FIGS. 5*a* and 5*b*. The sensor 501 generally consists of a switch housing 505, a pressure switch piston 502, a coil spring 504, a set of terminal pins 508, and a pressure switch chamber 510. The pressure switch chamber 510 is in the shape of an elongated cylinder allowing the pressure switch piston 502, which is slidably mounted within the hollow housing 505, to travel longitudinally within the pressure switch chamber 510. To guide the movement of the pressure switch piston 502, the pressure switch chamber 510 has a slightly larger diameter than the disk-like pressure switch piston 502.

The set of terminal pins 508 consists of at least two posts 516 having electrically conductive tips 518. The terminal pins 508 are located on the same interior side of the pressure switch chamber 510 as the inlet 503, spaced a distance 520 from each other so that an electric current cannot pass from the tip of one terminal pin 522 to the tip of another terminal pin 524. Additionally, each post 516 is long enough to allow the electrically conductive material at the tip 518 of each post 508 to engage the electrically conductive segment 512 of the piston 502 when no air pressure is applied to the pressure switch piston 502 and the coil spring 504 biases the piston 502 against them.

The outlet of the pump 301 is connected to the same side of the pressure switch chamber 510 as the set of terminal pins 508 such that the air flow leaving an air outlet side 534 of the pump 301, the side outlet 330 of the pump piston rod 310 in the preferred embodiment, is concentrated into the pressure switch chamber 510, directing air flow pressure on the pressure switch piston 502 in a direction of force against the force of the coil spring 504.

In general, the pressure sensor 501 receives at least a portion of air flow exhausted from the vacuum source 15 through an inlet 503 of the sensor 501. When air begins to flow into the pressure sensor 501, the pressure switch piston 502, which is slidably mounted within the hollow housing 505, changes position within the housing 505 depending on the amount of air flowing into the sensor 501. The pressure switch piston 502 is preferably disk-shaped to register with the internal contour of the housing 505, and consists of a disk of electrically conductive material 512 attached to a disk of electrically insulating material 514. The coil spring 504 engages the pressure switch piston 502 at the electrically insulating material 514 with the opposite end of the coil spring 504 engaging an interior side of the pressure switch chamber 510. The spring is mounted to bias the piston towards the inlet 503.

A micro-chip controller 506 is electrically connected to the tip 518 of each terminal pin 508 such that when the electrically conductive segment 512 of the pressure switch piston 502 is in contact with the terminal pins 508, an electric current passes from the micro-chip controller 506, through the terminal pins 508 and piston 502, and then back to the micro-chip controller 506, thus creating a constant signal. This allows the micro-chip controller 506 to detect when the pressure switch piston 502 is in a first position 530 shown in FIG. 5*a* or a second position 532 shown in FIG. 5*b*. In the first position 530 shown in FIG. 5*a*, the electrically conductive segment 512 of the pressure switch piston 502 is in contact with the terminal pins 508 creating a closed circuit and the constant signal to the micro-chip controller 506. In the second position 532 shown in FIG. 5*b*, the electrically conductive segment 512 of the pressure switch piston 502 is pushed away from the terminal pins 508 by incoming air pressure a distance such that the spring 504 is compressed. In this position, electric current cannot pass from one terminal pin 522 to another terminal pin 524 through the electrically conductive segment 512 of the pressure switch piston 502. This position of the pressure switch piston 502 creates an open circuit resulting in the constant signal to the micro-chip controller 506 ceasing.

The outlet of the pump 301 is connected to the same side of the pressure switch chamber 510 as the terminal pins 508 such that the air flow leaving the air outlet side 534 of the pump 301, the side 330 of the pump piston rod 310 in the preferred embodiment, is concentrated into the pressure switch chamber 510, placing pressure on the pressure switch piston 502 in a direction of force against the force of the coil spring 504.

During operation, before the pump 301 is activated, the pressure switch piston 502 is in the first position 530 with the electrically conductive segment 512 in contact with the terminal pins 508. This causes a closed circuit and a constant signal to the micro-chip controller 506. Once the pump 301 is activated, air flows from the pump 301 into the pressure switch chamber 510. This air flow creates a force that pushes the pressure switch piston 502 into the second position 532 where the electrically conductive segment 512 is not in contact with the terminal pins 508. This creates an open circuit and stops current flow into the micro-chip controller 506 resulting in the constant signal to the micro-chip controller 506 ceasing, effectively informing the micro-chip controller 506 that air is being evacuated by the pump 301.

Once sufficient air is evacuated by the pump 301, the air flow from the pump 301 significantly decreases and the force on the pressure switch piston 502 is less than the force of the coil spring 504. The coil spring 504 biases the pressure switch piston 502 back into the first position 530.

The micro-chip controller 508 operates differently when receiving the new constant signal of the first position 530 depending on how the vacuum sealing apparatus 1 is being used. For example, when the pump 301 is being used to seal plastic bags, an outer door 10 of the bag-engaging assembly 3 actuates a microswitch 536, effectively causing the micro-chip controller 506 to activate a heating wire 538 and to not deactivate the pump 301 in response to a decrease in pressure within the sensor 501. When the vacuum sealing appliance 1 and the pump 301 are used in communication with the adaptor assembly 11 as discussed further below, the outer door 10 of the bag-engaging assembly 3 does not actuate the microswitch 536, thus causing the micro-chip controller 506 to deactivate the pump 301 and to not activate the heating wire 538 upon the decrease in pressure within the sensor 501.

Figure 6:
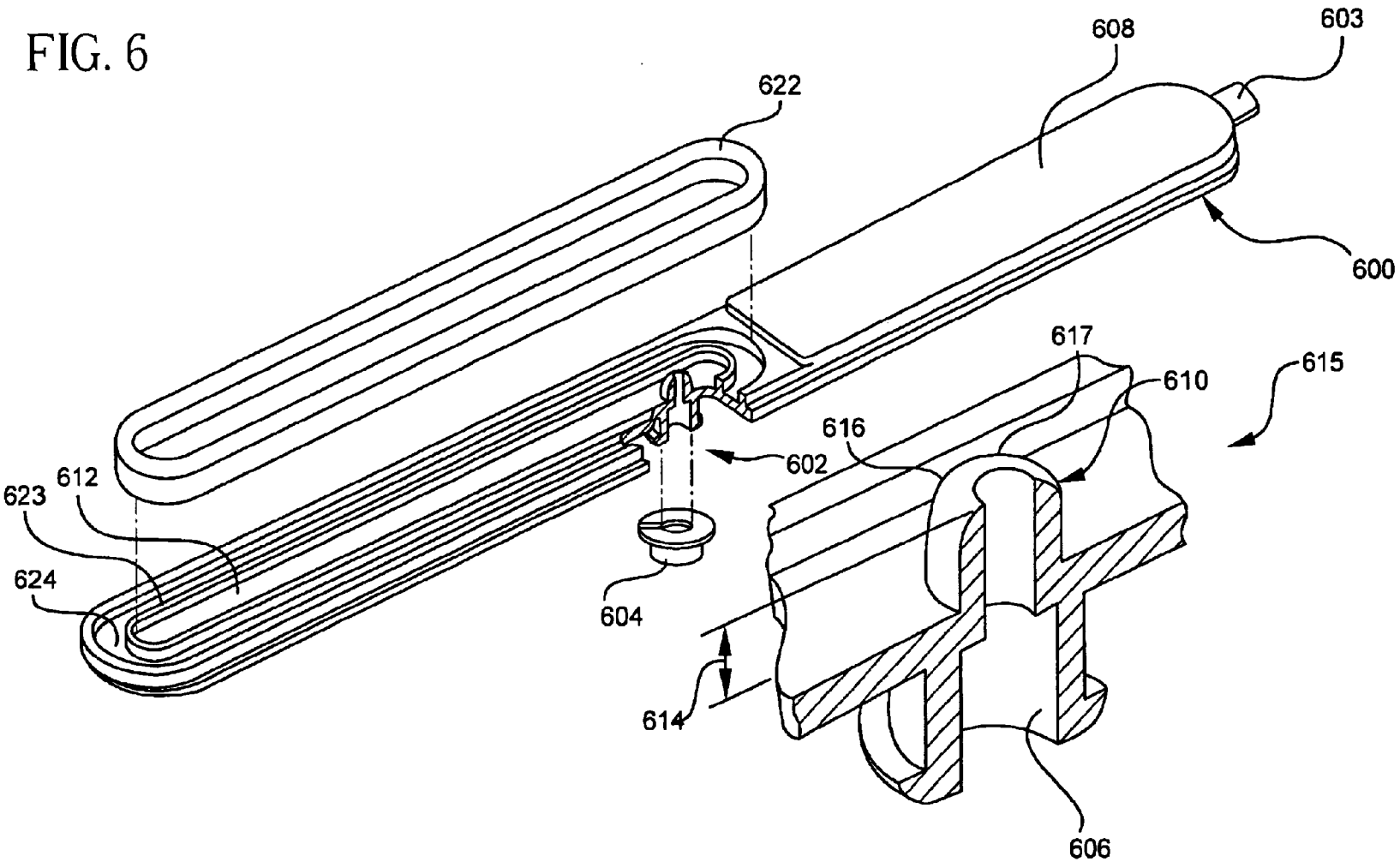
FIG. 6 is a perspective view of a drip pan used within the vacuum sealing appliance.

The vacuum inlet 14 is located within a recess 16 defined on the top of the base housing 2. A removable drip pan 4 rests in the recess 16 and is in communication with the vacuum inlet 14. The removable drip pan 4 is designed to collect excess food, liquid, or other particles to avoid clogging the vacuum source 15 when extracting air from a plastic bag. As shown in FIG. 6, the removable drip pan 4 generally consists of a lower side 600 and an upper side 608 which define an oval shape. An annular wall 623 defines a vacuum recess 612. The vacuum recess 612 is shaped as a concave region on the upper side of the drip pan 610 designed to collect food and liquids that accompany the evacuation of a plastic bag by the appliance 1 before such contaminants can enter the pump 301. The lower side 600 defines a lower-side vacuum port 602 and the upper side 608 defines an upper-side vacuum port 610 defining a hollow vacuum channel 606.

The lower-side vacuum port 602 forms a sealable fluid coupling with the port 610 on the upper side 608, positioned within the recess 612. The lower-side vacuum port 602 is surrounded by an O-ring 604, and is alignable with and insertable into the vacuum inlet 14. The O-ring 604 seals the connection between the vacuum inlet 14 and the port 602. The airtight seal allows the vacuum source 15 within the base housing 2 to efficiently draw air from the recess 612 through the lower-side vacuum port 602. Thus the vacuum source 15 is in communication with the upper-side vacuum port 610 through the vacuum channel 606 such that the vacuum source 15 efficiently draws air from the upper-side vacuum port 610 of the drip pan 4.

The upper-side vacuum port 610 extends to a height 614 above a lowermost point 615 of the vacuum recess 612 that allows a top 616 of the upper-side vacuum port 610 to sit above any liquids or food particles that may collect in the vacuum recess 612. This height 614 assists in avoiding the ingestion of any liquids or food particles into the vacuum source within the base housing 2.

After sufficient accumulation of waste, the removable drip pan 4 can be removed and the vacuum recess 612 cleaned to avoid further accumulation that could obstruct the upper-side vacuum port 610 during operation. To aid in removal, a thumb flange 603 extends from a side of the drip pan 4 with sufficient relief to allow a user to lift upwardly and easily free the drip pan 4 from the base housing 2.

To aid in the collection of excess food and liquids, the vacuum recess 612 preferably extends from approximately the center of the drip pan 4 to a first side 621 of the drip pan 4. A strip 622 made of a resilient and water-resistant elastomeric material such as rubber further defines the vacuum recess 612 by surrounding the perimeter of the vacuum recess 612 within an annular channel 624 defined by the annular wall 623. The rubber strip 622 is more pronounced in height than the annular wall 623, thus creating an airtight seal around the vacuum recess 612 when it is covered by the bag-engaging assembly 3. This seal allows the vacuum source 15 within the base housing 2 to evacuate air at the bag-engaging assembly 3 via the vacuum recess 612 and the upper-side vacuum port 610.

In order to draw air through the vacuum recess 612, the bag-engaging assembly 3 must cover the removable drip pan 4. As shown in FIG. 2, the bag-engaging assembly 3 is attached to the base housing 2. Preferably, the bag-engaging assembly 3 comprises two separately movable doors hinged to the base housing 2 such that when closed, the two doors lay against the base housing 2, each of which is configured to cover the above-described drip pan 4.

In one embodiment, the bag-engaging assembly 3 consists of a rigid inner door 6, a nozzle 8, and an outer door 10. In general, the nozzle 8 is positioned so that a plastic bag may be positioned around the nozzle 8 and the bag-engaging assembly 3 may isolate the interior of the plastic bag from ambient air so that the vacuum source 15 within the base housing 2 can draw air from the plastic bag by drawing air through the nozzle 8 on the inner door 6. The inner door 6 and outer door 10 form a clamping arrangement for engagement of the plastic bag around the nozzle 8.

The inner door 6, when closed, completely covers the drip pan 4 and the vacuum recess 16. When closed, the lower side 18 of the inner door 6 contacts and engages the rubber strip 622 surrounding the perimeter of the vacuum recess 612. To aid in forming an airtight seal with the rubber strip 622 on the removable drip pan 4, the underside 18 of the inner door 6 is overlayed by a layer of cushioned elastomeric material. Therefore, when pressure is applied to the top surface 22 of the inner door 6, the inner door 6 is compressed against the rubber strip 622 of the drip pan 4, causing the elastomeric material to engage the rubber seal and form an airtight seal between the vacuum recess 612 and the underside 18 of the inner door 4.

The nozzle 8 is preferably a one-piece hollow structure with reinforcing members 23 extending from its sides. The nozzle 8 is preferably a squared-off, tubular member defining a free flowpath between the top surface 22 of the inner door 6 and the underside 18 of the inner door 4. The nozzle 8 passes through and is attached to the inner door 6 with a lower end 24 of the nozzle 8 opening into the vacuum recess 612. In this position, the upper portion of the nozzle extends horizontally and the lower end extends vertically through an opening in the inner door 4. The lower end of the nozzle 24 is generally aligned with the vacuum recess 612 so that when an airtight seal is formed between the underside 18 of the inner door 6 and the vacuum recess 612, the nozzle 8 is in communication with the vacuum recess 612. Preferably, the lower end of the nozzle 24 is offset longitudinally from the upper-side vacuum port 610 within the vacuum recess 612. This assists the collection of liquids or excess particles in the bottom of the vacuum recess 612 instead of allowing the liquids or excess particles to pass directly to the upper-side vacuum port 610, possibly obstructing airflow. Thus, air may continuously flow towards the vacuum source 15 through the recess 612, drip pan 4, and nozzle 8 on the top surface 22 of the inner door 6. The forward end of the nozzle 8A extends forwardly from the inner door 6.

Due to the communication between the vacuum source 15 within the base housing 2 and the vacuum recess 612, the vacuum source 15 is in fluid communication with the nozzle 8 such that the vacuum source 15 can efficiently draw air from the nozzle 8. Therefore, when a flexible container, such as a plastic bag, is placed around the nozzle 8 and isolated from ambient air, the vacuum source can evacuate air from the interior of the plastic bag via the nozzle 8.

As noted above, the outer door 10 is configured to isolate an open end of a plastic bag from ambient air while the nozzle 8 on the inner door 6 is in communication with the interior of the plastic bag. An underside of the outer door 26 defines an outer door recess 28 which is slightly concave and covered with flexible, cushioned elastomeric material. When the outer door 10 is closed, the outer door recess 28 contacts and presses down on the top surface of the inner door 22, which, as noted above, includes the elastomeric material and the nozzle 8. Therefore, when the top surface of the inner door 22 and the underside of the outer door 26 are compressed over a bag placed around the nozzle 8, a generally airtight seal is formed between the two layers of cushioned elastomeric material and generally around the head of the nozzle 8 positioned between the two layers. The remainder of the edges of the open end of the plastic bag are held together tightly between the inner and outer doors 22 and 26.

To seal the plastic bag closed, a sealing assembly 5 is forwardly mounted on the underside of the outer door 26. As shown in FIG. 2, the sealing assembly 5 preferably includes a heating wire 12 mounted forwardly on the underside of the outer door 26. When closed, the heating wire 12 aligns with and overlays a rubber strip 32 mounted forwardly along the base housing 2. The heating wire 12 is mounted such that when the outer door 26 is closed, the heating wire 12 engages the plastic bag laying across the rubber strip 32 being evacuated through the nozzle 8. The heating wire 12 and rubber strip 32 are mounted forwardly to prevent the nozzle 8 from interfering with the seal.

The heating wire 12 is in communication with the pressure sensor 501 and a timing circuit such that when the micro-chip controller 506 energizes the heating wire 12 due to the pressure sensor 501 detecting a significant decrease in the amount of air leaving the vacuum source 15, the timing circuit activates the heating wire 12 for a predetermined time that is sufficient for sealing to occur. A step-down transformer 7 in the base housing 2 steps down the voltage supplied the heating wire 12.

Preferably, two openings 36 on the base housing 2 are located on either side of the rubber strip 32 to receive latches 34 on the outer door 10 to assure that the heating wire 12 evenly engages the plastic bag laying across the rubber strip 32. The latches 34 also provide hands-free operation so that once the outer door 10 latches to the base housing 2, the plastic bag is secure in the vacuum appliance 1 and no further action is needed by the user to hold the bag in place. Preferably, two release buttons 37 are located on the base housing 2 to release the latches 34 from the base housing 2.

During operation of this embodiment of the vacuum-sealing appliance 1, a plastic bag 700 is preferably first removed from the plastic bag roll and cutting assembly 9 mounted on the base housing 2. The plastic bag roll and cutting assembly 9 generally comprises a removable cutting tool 42 and a removable rod 40 fixed at both ends within a concave recess 38 defined in the base housing 2. To remove the cutting tool 42 for replacement or cleaning, a user may remove a plate 44 on the front of the base housing 2 which secures the cutting tool 42 in a track 46 running parallel to the front of the base housing 2. The track 46 allows the cutting tool 42 to slide from left to right, or from right to left along the front of the base housing 2.

The rod 40 holds a roll containing a continuous plastic sheet from which a user can unroll a desired length of plastic bag 700. The cutting tool 42 then cuts the plastic bag from the remaining roll by sliding the cutting tool 42 across the plastic bag 700 in a continuous left to right, or right to left motion.

Once removed from the plastic bag roll, the plastic bag 700 is unsealed on two ends. To seal one of the unsealed ends of the plastic bag 700, an unsealed end is placed over the rubber strip 32 of the base housing 2 and the outer door 10 is closed so that the heating wire 12 engages the rubber strip 32. No engagement with the nozzle 8 is necessary. To activate the heating wire 12, a user may momentarily depress and releases a sealing switch 48. This action activates the heating wire 12 without activating the vacuum source 15, resulting in the activated heating wire 12 fusing layers of the plastic bag 700 together, causing them to form an airtight seal. The heating wire 12 continues to fuse the layers of the plastic bag 700 until a predetermined amount of time passes and the timing circuit deactivates the heating wire 12. The plastic bag 700 is removed, resulting in a plastic bag with airtight seals on three sides.

Figure 7:
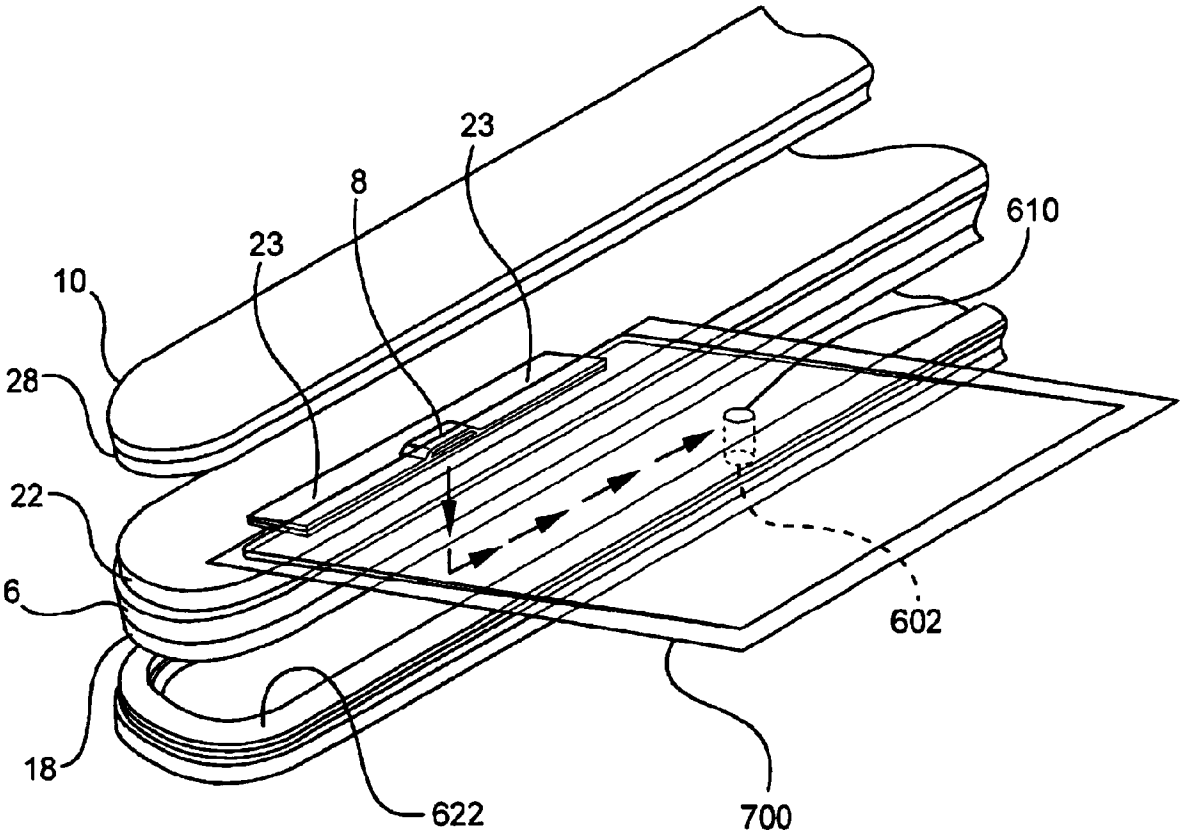
FIG. 7 is a partial view of the vacuum sealing appliance showing a plastic bag placed over a nozzle on an inner door for vacuuming.

As shown in FIG. 7, after being filled with appropriate material, the inner door 6 is closed over the recess and the drip pan 4, and the plastic bag 700 is placed around the nozzle 8. It should be noted that any type of plastic bag 700 that is sealed on three sides, partially filled with appropriate material, is gas impermeable, and consists of suitable material for heat-sealing, is appropriate for use with the system.

The outer door 10 is then closed against the inner door 6 and the base housing 2. As discussed above, pressure creates an airtight seal between the drip pan 4 and the inner door 6. Additionally, pressure creates a generally airtight seal between the inner door 6 and the outer door 10 when compressed over the plastic bag 700 placed around the nozzle 8. The latch 34 engage the hole 36 on the base housing 2 to hold the outer door 10 against the base housing 2 and sustain the pressure between the outer door 10 and the inner door 6. To activate the vacuum source, a user may momentarily depress and release a vacuum switch 50. Once activated, the vacuum source 15 draws air from the interior of the plastic bag 700 through the nozzle 8 and into the vacuum recess 612. Any liquids or other food particles evacuated from the plastic bag 700 through the nozzle 8 fall into the vacuum recess 612 of the drip pan 4 while the vacuum source 15 continues to draw air.

Once sufficient air is evacuated from the plastic bag 700, the pressure sensor 501 detects a significant decrease in the amount of air flow from the plastic bag 700. The heating wire 12 is then activated for a set period of time. The vacuum source 15 continues to draw air from the interior of the plastic bag 700 while the activated heating wire 12 fuses layers of the plastic bag 700 together, causing them to form an airtight seal. The heating wire 12 continues to fuse the layers of the plastic bag 700 until a predetermined amount of time passes and the timing circuit deactivates the heating wire 12.

After operation, the outer door 10 may be lifted and the sealed plastic bag 700 removed from the nozzle 8. Additionally, after the plastic bag 700 is removed, the inner door 6 can be easily lifted to expose the recess and the drip pan 4 removed for cleaning.

Figure 8:
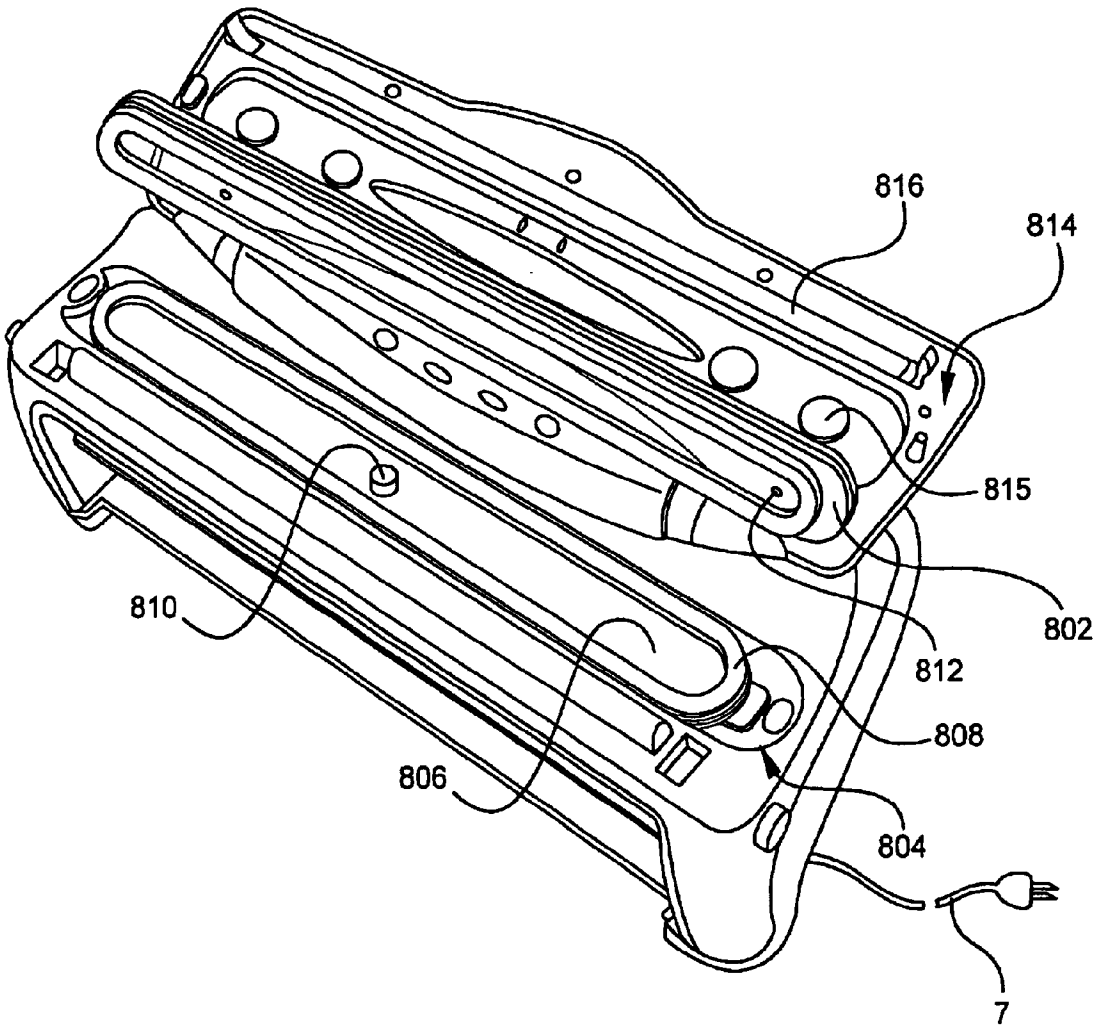
FIG. 8 is a perspective view of a second embodiment of a vacuum sealing appliance in accordance with the present invention.

In another embodiment of the vacuum sealing appliance 1, shown in FIG. 8, the configuration of the rigid inner door 802 and the configuration of the removable drip pan 804 are modified. In the drip pan 804, the vacuum recess 806 whose perimeter is lined by the rubber strip 808 spans the entire length of the drip pan 804. As in the previous embodiment, the top-side vacuum inlet 810 is preferably located within the removable drip pan 804 such that extraneous liquid and food particles evacuated from a plastic bag are not easily drawn into the top-side vacuum inlet 810, but rather fall to the bottom of the vacuum recess 806.

In this embodiment, the inner door 802 does not contain a nozzle. The inner door 802 instead contains an air vent 812 that allows air to pass through the inner door 802. When the air vent 812 is open, it prevents the vacuum source 15 within the base housing 2 from creating a vacuum within the vacuum recess 806. To close the air vent 812, and thereby allow the vacuum source 15 within the base housing 2 to efficiently draw air from the vacuum recess 806, the outer door 814 must be closed. By closing the outer door 814, a rubber pad 815 seals the air vent 812 by embracing the air vent 812 and covering it. Sealing the air vent 812 seals the vacuum recess 806 from ambient air and allows the vacuum source 15 within the base 2 to efficiently draw air from the vacuum recess 806.

Figure 9:
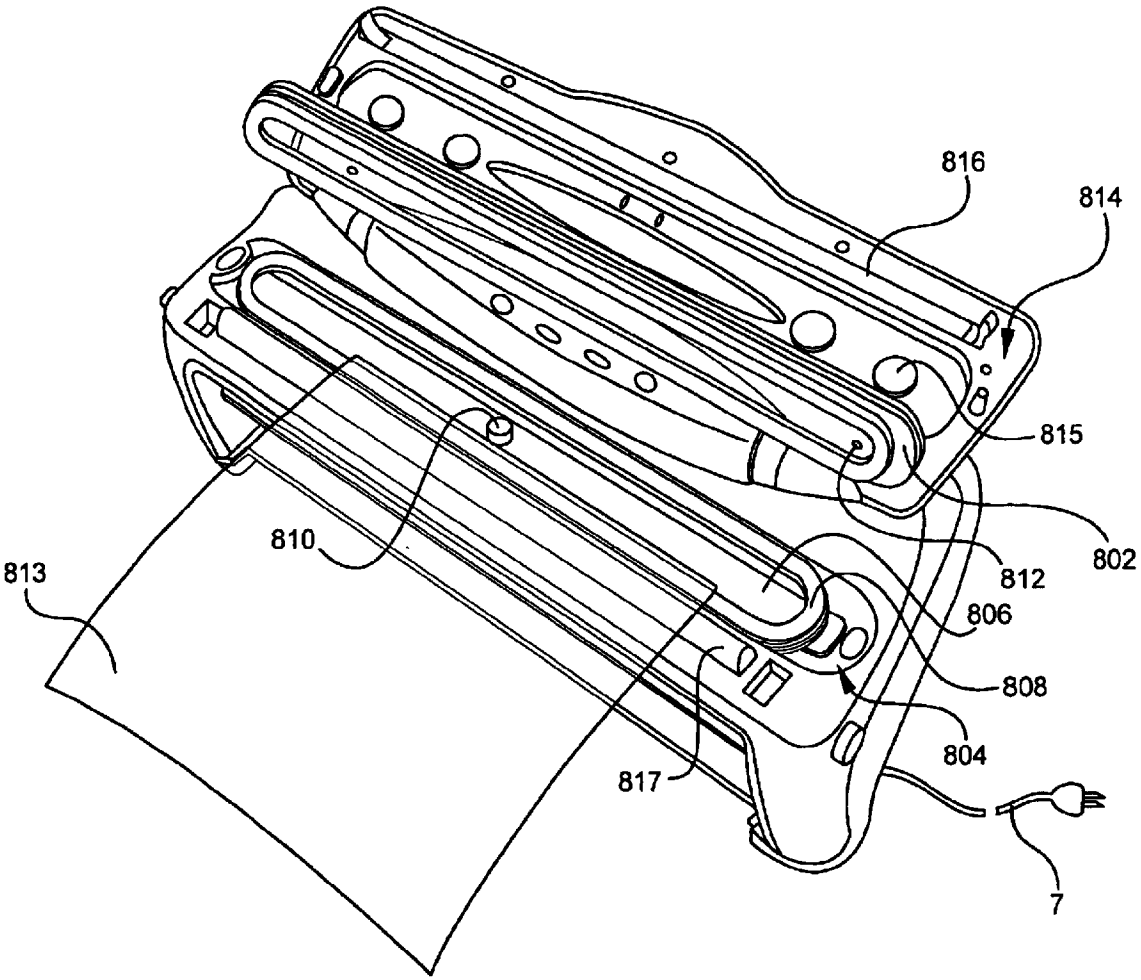
FIG. 9 is a perspective view of the second embodiment of the vacuum sealing appliance showing an open end of a plastic bag placed over a vacuum recess.
Figure 10:
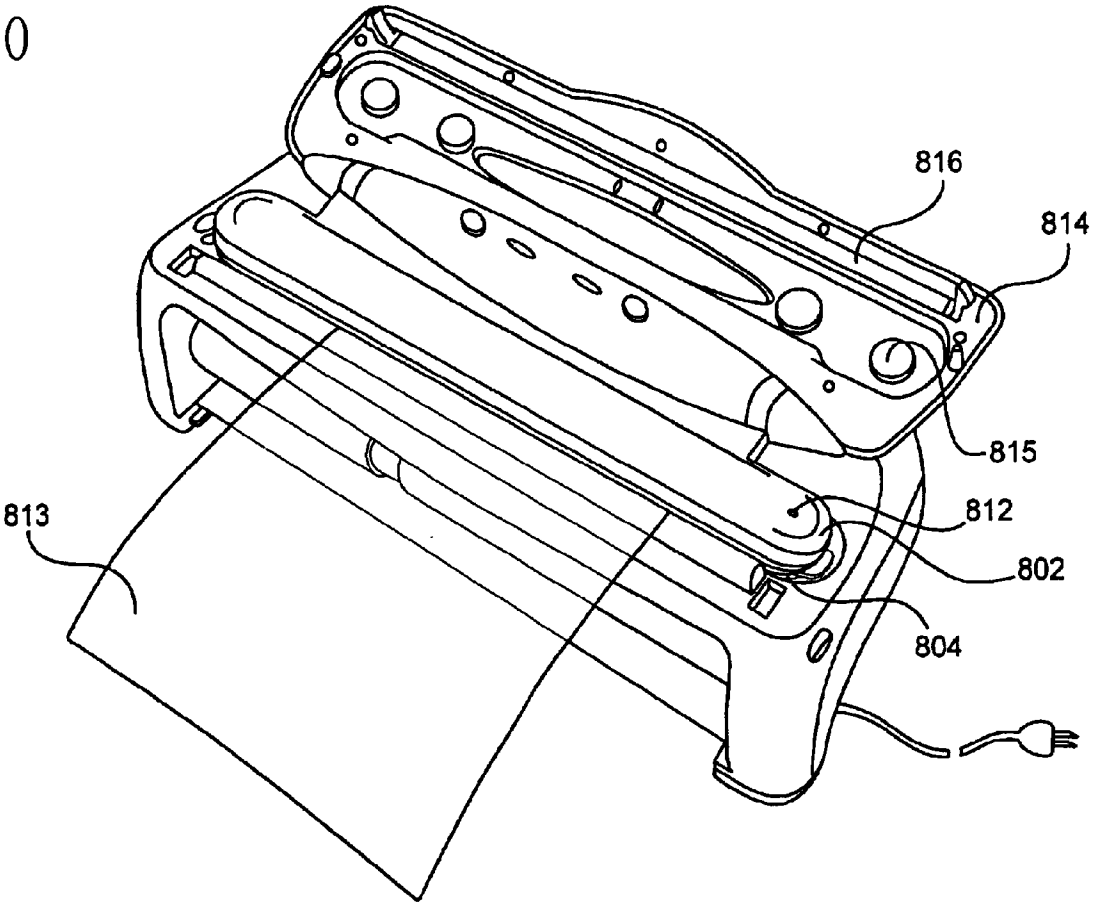
FIG. 10 is a perspective view of the second embodiment of the vacuum sealing appliance showing an inner door closed against a plastic bag to hold the plastic bag in position for vacuuming.

As shown in FIG. 9, during operation of this embodiment, the open end 817 of a plastic bag 813 that is sealed on three sides is placed within the vacuum recess 806. The inner door 802 is closed, engaging the outer panels of the bag between the inner door 802 and the drip pan 804 as shown in FIG. 10. At this point, the plastic bag 813 is not isolated from the ambient air due to the air vent 812.

Figure 11:
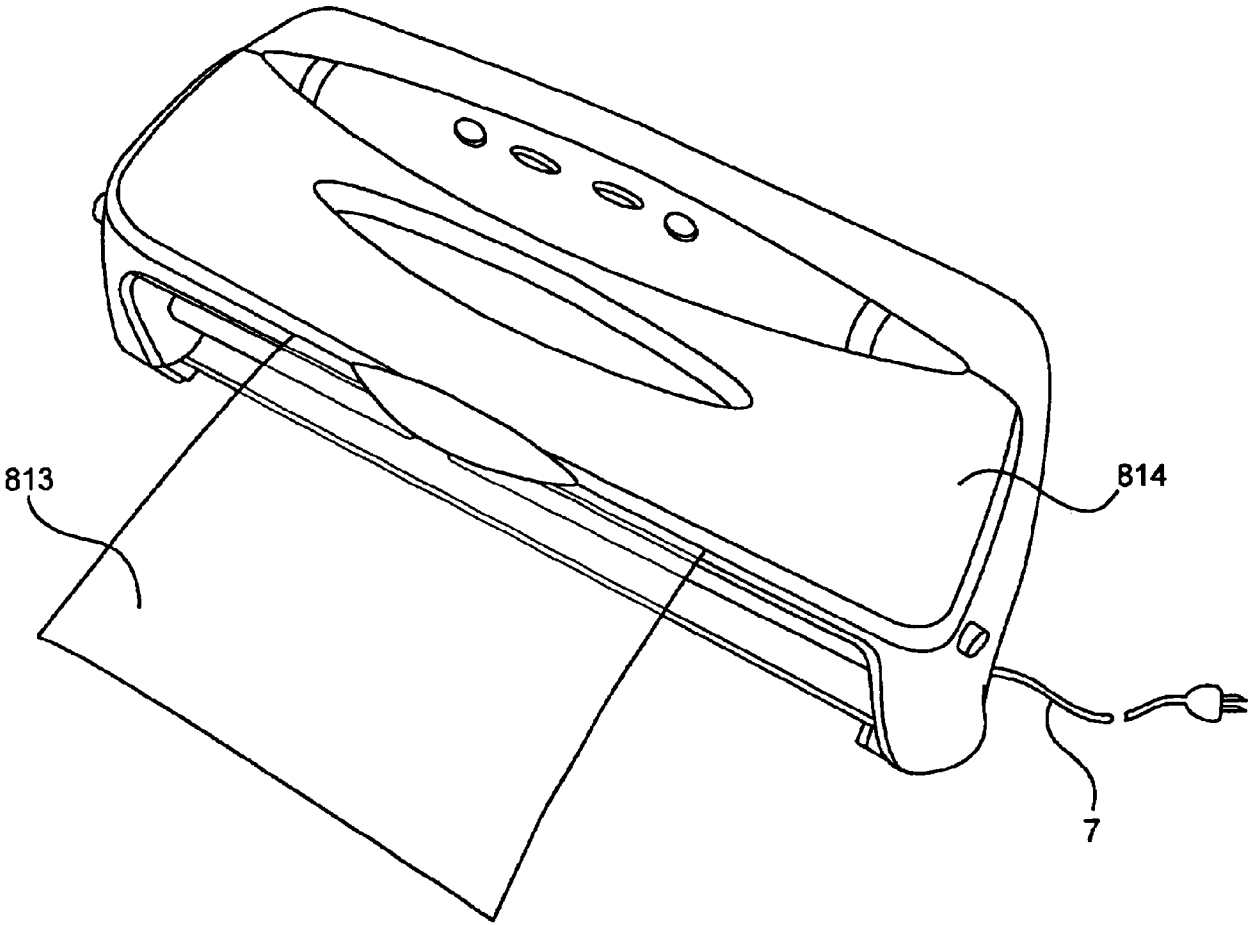
FIG. 11 is a perspective view of the second embodiment of the vacuum sealing appliance showing an outer door closed against the inner door to isolate the plastic bag from ambient air.

Once the plastic bag 813 is secured in the vacuum recess 806, the outer door 814 is closed, as shown in FIG. 11, sealing the air vent 812 and isolating the plastic bag 813 from ambient air. A user may momentarily depress and release a vacuum switch 50 to activate the vacuum source 15 within the base housing 2. Once activated, the vacuum draws air from the interior of the plastic bag 813 and into the vacuum recess 806. As the vacuum source draws air from the interior of the plastic bag 813, excess liquids and food particles are collected in the bottom of the vacuum recess 806 after which the vacuum continues to draw air into the upper-side vacuum inlet 810.

Once sufficient air is evacuated from the plastic bag 813, the pressure sensor 501 detects a significant decrease in the amount of air flow from the plastic bag 813. The heating wire 816 is then activated. When the heating wire 816 is activated, the vacuum source 15 continues to draw air from the interior of the plastic bag 813 while the heating wire 816 fuses layers of the plastic bag 813 together, causing them to form an airtight seal. The heating wire 816 continues to fuse layers of the plastic bag 813 until a predetermined amount of time passes and the timing circuit deactivates the heating wire 816. Once sealed, the outer door 814 and inner door 802 are lifted. The sealed plastic bag 813 is removed and the removable drip pan 804 can be removed for cleaning.

Figure 12A:
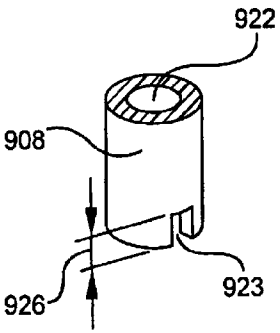
FIG. 12*a* is an enlarged view of an end of the vacuum post within the adaptor.
Figure 12:
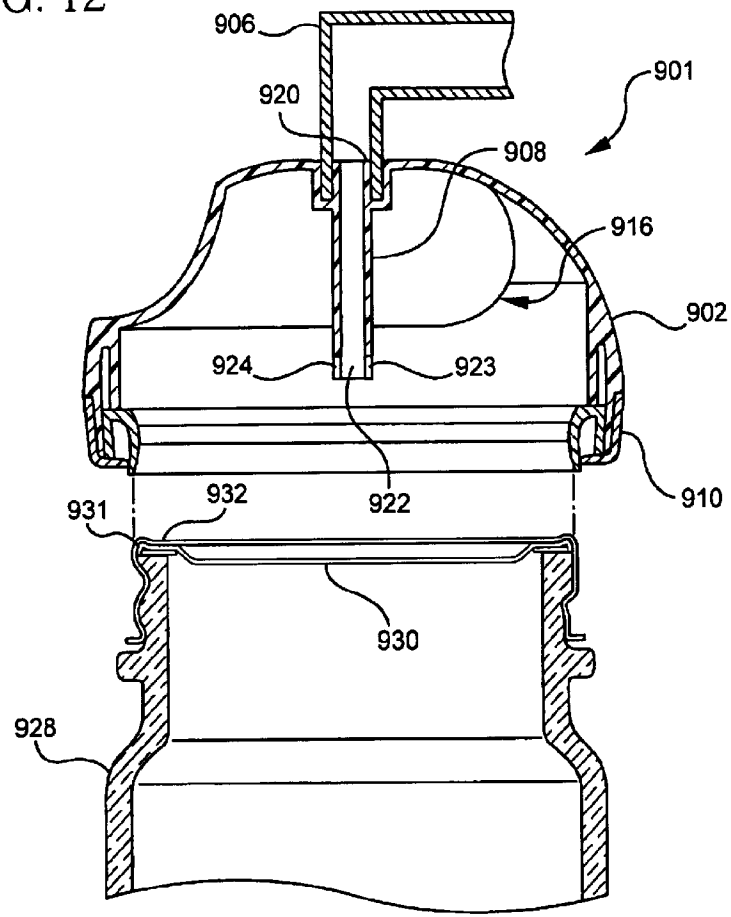
FIG. 12 is a side view of an adaptor of the vacuum sealing system above a mason jar.
Figure 13:
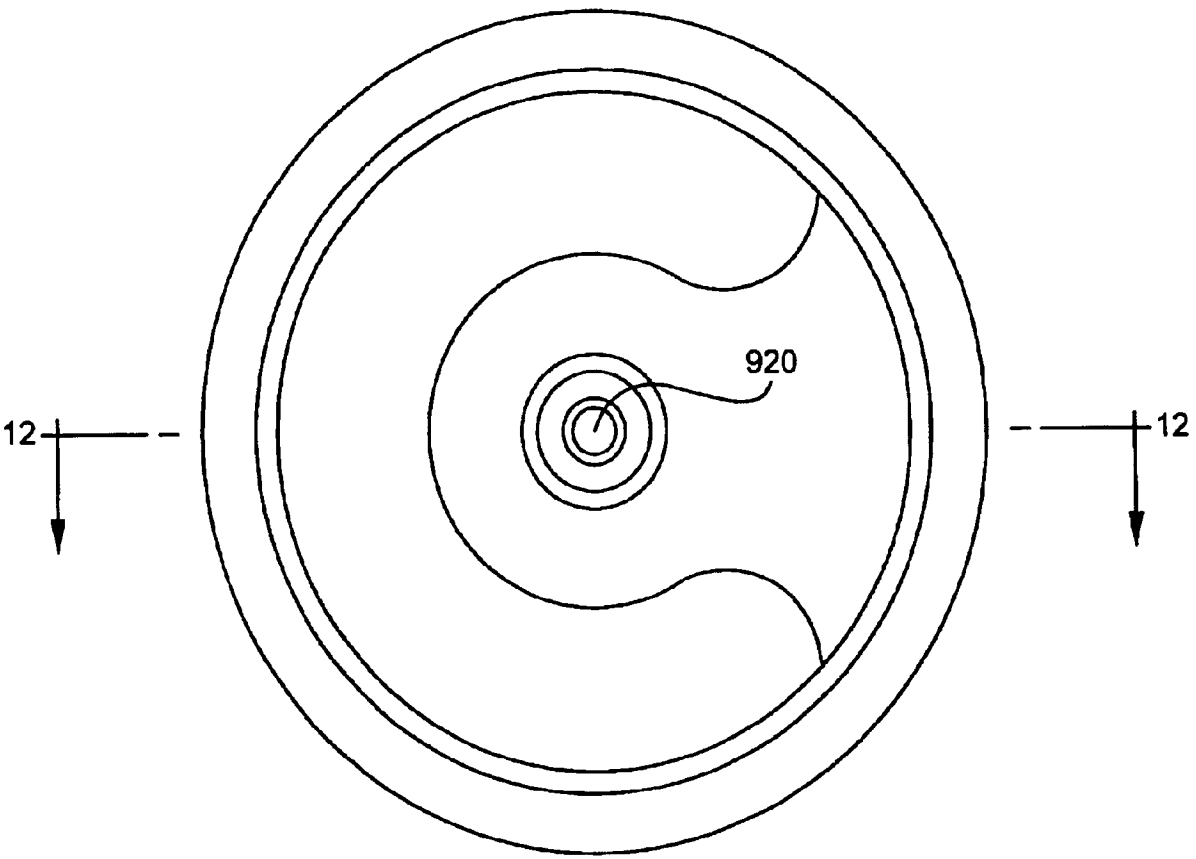
FIG. 13 is a top view of the adaptor of the vacuum sealing system.

An adaptor assembly 11 may be used in conjunction with the base housing 2 as shown in FIG. 1 to evacuate separately provided storage containers. An adaptor 901, shown in FIGS. 12 and 13, generally includes an adaptor casing 902, a rubber gasket 904, an adaptor tube 906, and a vacuum post 908. The adaptor 901 is in communication with the vacuum source 15 of the base housing 2 to create a vacuum within an interior space 916 defined within the adaptor 901. The adaptor 901 can be placed over the open end of a jar-like container to be evacuated, such as a mason jar. The adaptor 901 uses the vacuum source 15 to draw air from the attached container.

Figure 14:
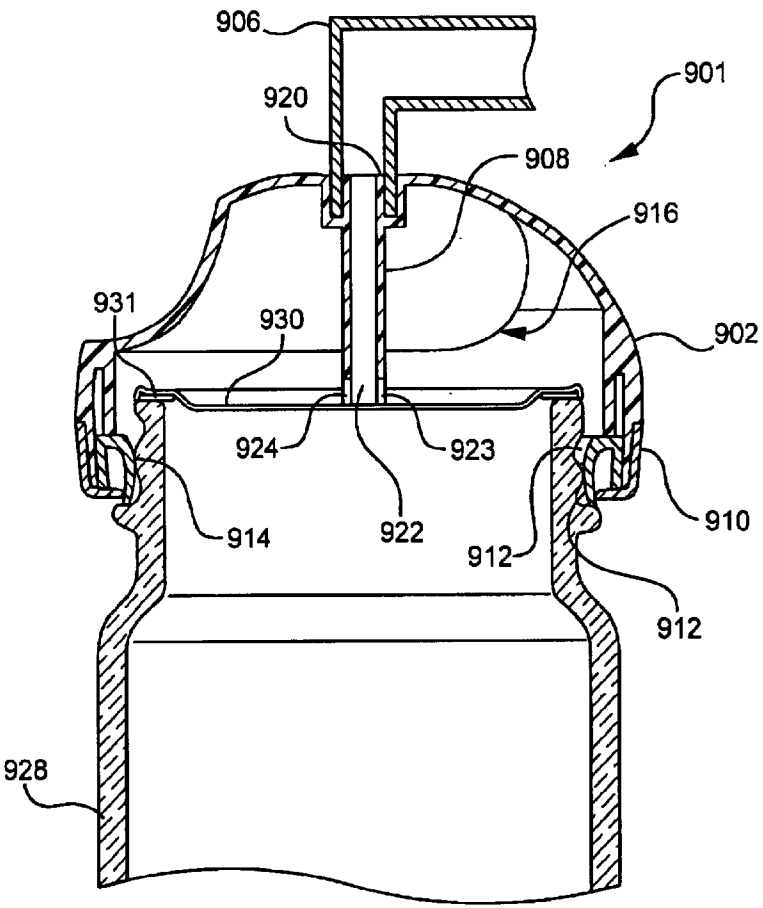
FIG. 14 is a side view showing the adaptor resting on a mason jar.

Preferably, the adaptor casing 902 is generally dome-shaped or semispherical, thereby defining the cup-like interior 916 to the adaptor casing 902. A lower area 910 of the adaptor casing 902 is surrounded on its perimeter by the circular rubber gasket 904 having an upper portion 912 and a lower portion 914. The upper portion 912 of the rubber gasket is attached to the interior 916 of the adaptor casing 902 to allow the lower portion 914 of the rubber gasket 904 to form a flange. The flange portion of the rubber gasket 904 cooperates with the portion 912 of the gasket and the lip 902A of the casing to form an annular gasket recess 904A. The flange is movable inwardly toward the center of the adaptor casing 902 and away from the lip 902A of the casing. This inward movement allows the gasket recess 904A and the rubber gasket 904 to embrace and seal a container mouth on which the adaptor casing 902 is placed as shown in FIG. 14, forming a virtually airtight, substantially hermetic seal between the interior 916 of the adaptor casing 902 and a mouth or opening of the container.

The vacuum post 908 extends from a center point in the interior 916 of the adaptor casing 902 toward the lower area 914 of the adaptor casing 902. The post 908 is of sufficient length to allow the adaptor casing 902 to rest on the top of a container. The vacuum post 908 defines an air passageway 922 running from an end 924 of the vacuum post 908 in the interior 916 of the adaptor casing 902 to an air valve 920 on the exterior of the adaptor casing 902. The end 924 of the vacuum post 908 additionally defines slits 922 allowing air to be drawn into the sides of the vacuum post 908 if the end 924 is obstructed.

The adaptor tube 906 includes two ends, one attached to the vacuum source 15 at the upper-side vacuum port 610 on the drip pan 4 and one attached to the exterior of the adaptor casing 902 at the air valve 920. The end of the adaptor tube 906 which connects to the upper-side vacuum port 610 includes an adaptor that allows the adaptor tube 906 to insert inside the vacuum channel 606 defined by the upper-side vacuum port 610. The end of the adaptor tube 906 which connects to the adaptor casing 902 at the air valve 920 is connected to an L-shaped adaptor that fits over and embraces the exterior of the air valve 920.

During operation, the adaptor tube 906 is attached to the vacuum source 15 and the adaptor 901 is placed over a canister or a mason jar 928 with a disk-like lid 930. The mason jar or canister 928 is preferably inserted until the vacuum post 908 rests against the lid 930 and the rubber gasket 904 of the adaptor 901 surrounds or contacts the sides of the mason jar or canister 928. To activate the vacuum source 15, a user may momentarily depress and release a vacuum switch 50 on the base housing 2. Once activated, the vacuum source 15 draws air from the end 924 of the vacuum post 908 by drawing air through the adaptor tube 906 and the air passage way 922.

In the case of a mason jar 928, drawing air from the end 924 of the vacuum post 908 creates a vacuum within the interior 916 of the adaptor casing 902, which forces the lower portion 914 of the rubber gasket 904 to move inward and embrace the sides of the mason jar 928 to form a seal. Drawing air from the interior 916 of the adaptor also causes portions of the outer edges 931 of the disk-like lid 930 to bend upwardly around the centrally located vacuum post 908 due to the air pressure in the mason jar 928 while the center of the lid 930 stays in place due to the vacuum post 908. The bending of the outer edges 931 allows the vacuum source to draw air from the interior of the mason jar 928 to equalize pressure with the interior 916.

Once the air pressure above and below the lid 930 equalize, the outer edges 931 of the lid 930 flex back to their normal position and the lid 930 rests flat against the top of the mason jar 928. At this time, the pressure sensor 501 detects a significant decrease in the amount of air leaving the vacuum source 15 and a signal is sent to the micro-chip controller 506. The micro-chip controller 506 deactivates the vacuum source 15 and the adaptor casing 902 may be removed from the vacuum source 15, allowing air to return into the interior 916 of the adaptor casing 902. Ambient air pressure pushes the lid 930 securely on the mason jar 928 and effectively seals the mason jar 928 from ambient air. The adaptor casing 902 is removed and a metal retaining ring 932 can be placed around the lid 930 of the jar to secure the disk-like lid 930.

Figure 15:
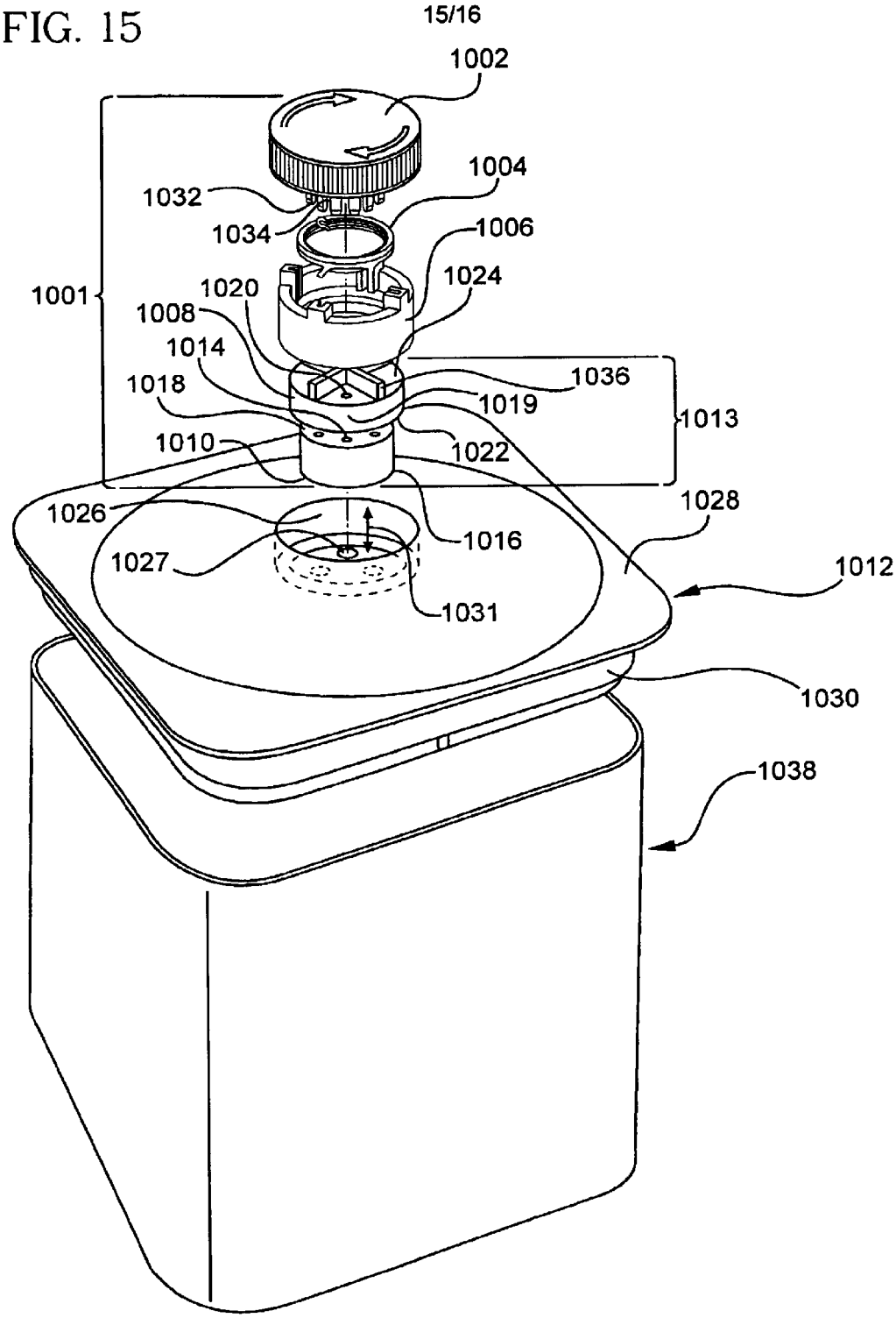
FIG. 15 is a perspective view of a canister of the vacuum sealing system having an exploded view of a canister lid valve assembly.

The adaptor 901 is additionally compatible with a canister 1038 implementing a canister lid valve assembly 1001. As shown in FIG. 15, the canister 1038 is shaped with a complementary lid 1012 including the canister lid valve assembly 1001. The canister lid valve assembly 1001 allows a user to easily seal an interior of the canister 1038 from ambient air after a vacuum source extracts sufficient air from the interior of the canister 1038. The canister lid valve assembly 1001 additionally allows a user to easily allow ambient air back into the interior of the canister 1038 by simply turning a knob on the canister.

The canister lid valve assembly 1001 generally includes a knob 1002, a plate spring 1004, a piston pipe 1006, a piston ring 1008, and a rubber piston 1010. These components are positioned within an opening defined in the canister lid 1012.

The piston ring 1008 mounted on one end of the rubber piston 1010 create a piston assembly 1013, which is mounted to move upwardly and downwardly based on relative air pressure above and below the canister lid valve assembly 1001. When the piston assembly 1013 moves upwardly, the vacuum source 15 can draw air from the interior of the canister 1038. Once sufficient air is drawn from the interior, the piston assembly 1038 moves downwards to seal the interior from ambient air and effectively seal the evacuated interior. To allow ambient air back into the interior of the canister 1038, the knob 1002 may be turned, which in turn rotates the piston assembly 1013 to vent air from the canister 1038.

The rubber piston 1010 is preferably cylindrical with at least one, preferably two passageways 1014 extending longitudinally along the length of the rubber piston 1010 that are large enough to sustain air flow between a lower side of the rubber piston 1016 and an upper side of the rubber piston 1018.

The piston ring 1008 is preferably disk-shaped, having an annular lip 1019 extending downwardly to embrace the rubber piston 1010. As with the rubber piston 1010, the piston ring 1008 defines matching passageways 1020 large enough to sustain air flow between a lower side 1022 of the piston ring 1008 and an upper side 1024 of the piston ring 1008. The piston ring passageways 1020 are spaced to align with the rubber piston passageways 1014. During assembly, the rubber piston 1010 is inserted into the piston ring 1008 with their respective passageways aligned so that air can flow between the top of the piston ring 1024 and the lower side of the rubber piston 1016.

The piston assembly 1013 rests in a central recess 1026 defined in the canister lid 1012. The central recess 1026 further defines matching passageways 1027 to sustain air flow between an upper portion 1028 of the lid 1012 and a lower portion 1030 of the lid 1012 when the passageways are unobstructed. The central recess passageways 1027 are alignable with the rubber piston passageways 1014 so that when the two sets of passageways are aligned, they are in direct communication with a corresponding pair of passageways in the piston assembly 1013.

The piston assembly 1013 is designed to obstruct and seal the central recess passageways 1027 when the central recess passageways 1027 are not rotatably aligned with the rubber piston passageways 1014. The piston assembly 1013 and central recess 1026 are also designed to allow the piston assembly 1013 to move upwardly and downwardly a distance 1031 within the central recess 1026 depending on whether a vacuum is present. The distance 1031 is sufficient enough to sustain an air flow from the interior of the canister through the central recess passageway 1027.

To prevent the piston assembly 1013 from exiting the central recess 1026 when a vacuum force is applied to the piston assembly 1013, the piston pipe 1006 is inserted into the central recess 1026 over the piston assembly 1013. The piston pipe 1006 frictionally embraces the walls of the central recess 1026 so that the piston pipe 1006 is generally fixed. It may also be affixed with an adhesive compound.

The knob 1002 may be positioned over the pipe 1006, and consists of a circular disk 1033 attached to a set of downwardly extending fingers 1032. The fingers 1032 pass through a hollow area in the center of the piston pipe 1006 and rotationally engage the piston ring 1008. Each finger 1032 defines at least one slot 1034 with a size corresponding to a tab 1036 extending upwards from the piston ring 1008. Each finger 1032 captures at least one tab 1036 so that the knob 1002 and piston assembly 1013 are in direct communication.

Due to the communication between the knob 1002 and the piston assembly 1013, when the knob 1002 is rotated the entire piston assembly 1013 rotates. This movement changes whether the rubber piston passageways 1014 are aligned with the central recess passageways 1027, thereby changing whether air can flow between the upper portion 1028 of the lid 1012 and the lower portion 1030 of the lid 1012, or whether the piston assembly 1013 effectively forms a seal over the central recess 1026 due to the rubber piston passageways 1014 being offset from the central recess passageways 1027.

Figure 16:
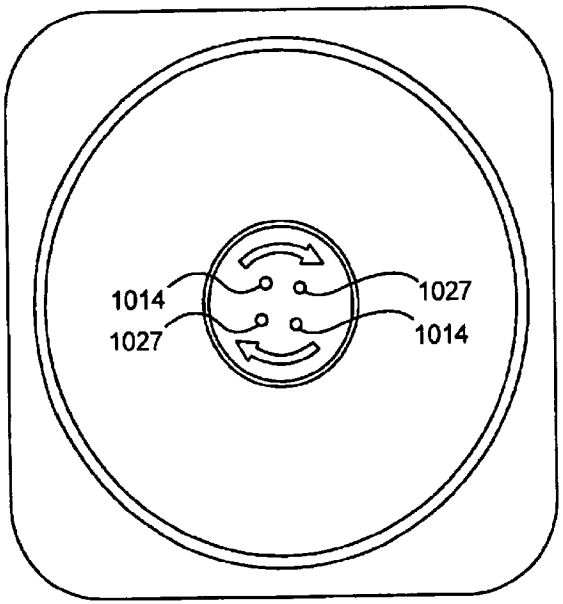
FIG. 16 is a bottom view of the canister lid valve assembly showing the central recess passageways and the piston passageways not aligned.

The plate spring 1004, which is a torsion-type spring, rests within the piston pipe 1006 having one end embracing the knob 1002 and another end embracing the piston pipe 1006. The plate spring 1004 places a rotary bias on the knob 1002 in a counterclockwise direction such that for the piston assembly 1013 to rotate in a clockwise direction, the knob 1002 must rotate in a clockwise direction against the bias of the plate spring 1004. The piston assembly 1013, knob 1002, and plate spring 1004 are designed to operate with the piston pipe 1006 such that when the plate spring 1004 is in a normal position as shown in FIG. 16, the knob 1002 is prevented from moving too far in a counterclockwise direction by a stop member (not shown) within the piston pipe 1006. In this normal position, the central recess passageways 1027 and rubber piston passageways 1014 are not aligned. Therefore, the central recess passageways 1027 are sealed so that air cannot pass from the lower side of the lid 1030 to the upper side of the lid 1028.

During operation, the lid 1012 is placed on a canister 1038 filled with appropriate material. A rubber gasket between the lid 1012 and the canister 1038 forms an airtight seal between the canister 1038 and the lid 1012 containing the canister lid valve assembly 1001 so that the only source of ambient air is the top of the lid 1012. A vacuum source is applied to the upper portion of the lid 1028 creating a vacuum within the central recess 1026. In one embodiment, the vacuum source 15 is applied using the adaptor 901 previously described, but other vacuum sources or adaptors may be used.

The force of the vacuum within the central recess 1026 pulls the piston assembly 1013 upwards allowing the vacuum source 15 to draw air from the interior of the canister 1038. More specifically, when a vacuum exists within the central recess 1026, the piston assembly 1013 lifts upwardly due to the air pressure within the canister 1038. Due to the upward position of the piston assembly 1013, the central recess passageways 1027 are no longer obstructed, allowing the vacuum source 15 to be in communication with the interior of the canister 1038.

After sufficient air exits the canister 1038, the air pressure between the upper portion 1028 of the lid 1012 and the lower portion 1030 of the lid 1012 equalizes, causing the piston assembly 1013 to descend to its original position. The vacuum source 15 can then be removed causing ambient air to surround the piston assembly 1013, forcing the piston assembly 1013 securely against the central recess passageways 1027 to seal the central recess passageway 1027 and the interior of the canister 1038 from ambient air.

Figure 17:
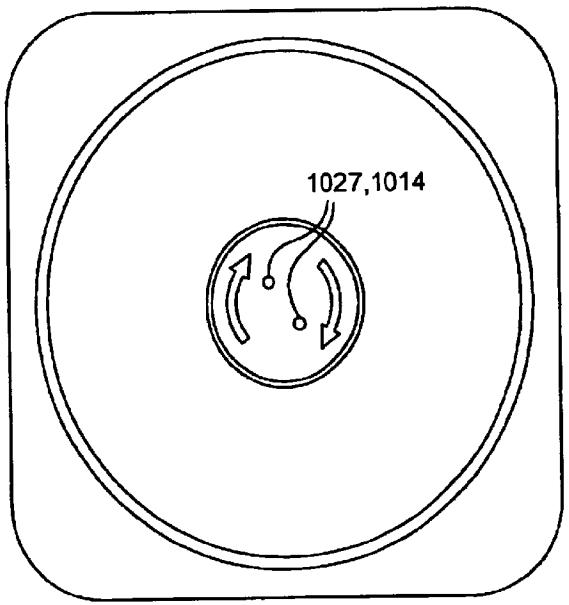
FIG. 17 is a bottom view of the canister lid valve assembly showing the central recess passageways and the piston passageways aligned.

When the user desires to open the canister 1038 and allow ambient air back into the canister 1038, the knob 1002 is rotated in a clockwise direction causing the piston assembly 1013 to rotate. The knob is only capable of rotating approximately 45° due to tabs or similar means to stop rotation. This rotation aligns the central recess passageways 1027 with the rubber piston passageways 1014 as shown in FIG. 17. The alignment allows ambient air to rush into the interior of the canister 1038. After the interior of the canister 1038 is equalized with the ambient air pressure, the lid 1012 can be easily removed for access to the contents of the canister 1038.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A method for evacuating a flexible container, said method comprising the steps of:

providing a vacuum sealing appliance comprising:

a base housing;

a recess defined within said base housing, said recess defining a vacuum inlet port;

a drip pan positioned within said recess and over said vacuum inlet port for preventing liquid from entering said port;

a vacuum source located within said base housing and in fluid communication with said inlet port;

a pair of clamping doors hingeably mounted to said base housing, said doors configured to cover said recess and retain a flexible container therebetween;

vacuum nozzle means in communication with said vacuum source; and heat sealing means mounted to at least one of said clamping doors;

placing an open end of said flexible container over a portion of said vacuum nozzle means, said container holding an amount of liquid;

closing said pair of clamping doors over said recess to engage said container aroung said nozzle and cover said recess;

activating said vacuum source to evacuate said container and draw a portion of said liquid into said nozzle;

collecting said portion of said liquid in said drip pan; and activating said heat sealing means to seal said container.

2. A method of evacuating a flexible plastic container, said method comprising the steps of:

providing an appliance comprising a base housing, a vacuum source mounted within said housing, at least one door hingeably mounted to said base, and a recess defined in said base housing and in communication with said vacuum source;

placing a removable drip pan into said recess;

placing an open end of said plastic container at least partially into said removable drip pan;

closing said at least one door to engage a portion of said plastic container between said door and said base;

operating said vacuum source to remove air from said container; and removing said drip pan from said recess.

3. The method of claim 2 further comprising the step of heat sealing said container after said step of operating said vacuum source.

4. The method of claim 3 further comprising the step of retaining liquid from said container within said drip pan.

5. The method of claim 2 wherein said drip pan further comprises a liquid retaining area defined thereon.

6. The method of claim 2 further comprising the step of cleaning said drip pan after removing said drip pan from said recess.

7. The method of claim 2 further comprising the step of placing said drip pan back into said recess.

8. A method for evacuating a flexible container, said method comprising the steps of:

isolating an open end of said flexible container from ambient air in a vacuum sealing appliance, said container holding an amount of liquid;

activating a vacuum source within said vacuum sealing appliance to evacuate said container and draw a portion of said liquid into a removable drip pan positioned in said vacuum sealing appliance, said drip pan defining a recessed area for receiving said liquid;

activating a heat sealing means mounted on said vacuum sealing appliance to seal said container;

removing said flexible container from said vacuum sealing appliance; and removing said removable drip pan from said vacuum sealing appliance.

9. The method of claim 8 further comprising the step of cleaning said drip pan after removal.

10. The method of claim 8 further comprising the step of placing said drip pan back into said vacuum sealing appliance.

11. In a method for evacuating a flexible container, of the type wherein said flexible container holding an amount of liquid is placed within a vacuum sealing appliance; a vacuum source within said vacuum sealing appliance is activated to evacuate said container and draw a portion of said liquid into an elongated recess positioned within said vacuum sealing appliance; and a heat sealing means mounted on said vacuum sealing appliance seals container, the improvement comprising:

collecting said liquid in a removable drip pan positioned in said vacuum sealing appliance in said recess, said drip pan defining an open area for receiving said fluid; and removing said drip pan for cleaning after said heat sealing means seals said container.

12. A new method for creating a vacuum within an evacuable lid and container combination comprising:

placing a vacuum source over an evacuable lid containing a canister lid valve assembly comprising:

a central recess chamber;

at least one central recess passageway defined within said central recess chamber, said at least one central recess passageway able to sustain an airflow between a lower side and upper side of said canister lid valve assembly;

a piston assembly resting within said central recess chamber such that said piston assembly is able to rotate within said central recess chamber;

at least one piston assembly passageway capable of sustaining an airflow through said piston assembly;

a piston pipe adjacent said central recess chamber to hold said piston assembly within said central recess chamber; and a knob mounted rotatably to said lid valve assembly and adjacent said piston assembly such that rotation of said knob creates rotation in said piston assembly within said central recess chamber, resulting in alignment of said central recess passageway and said piston assembly passageway, creating an airflow through said central recess passageway and said piston assembly passageway;

creating a vacuum within said canister lid valve assembly to move said piston assembly away from said at least one central recess passageway;

drawing air from an interior of said container up through said at least one central recess passageway and out of said canister lid valve assembly;

creating a vacuum within the interior of said container resulting in said piston assembly moving toward and obstructing said at least one central recess passageway to seal the interior of said container from ambient air; and allowing ambient air into said canister lid valve assembly to secure said piston assembly against said at least one central recess passageway.

13. The method of claim 12 further comprising:

rotating said knob to align said central recess passageway and said piston assembly passageway to allow ambient air into the interior of said container.

14. A system for evacuating containers comprising:

a base housing;

a recess defined within said base housing, said recess defining a vacuum inlet port;

a vacuum source located within said base housing and in fluid communication with said inlet port;

inner door hinged to said base housing, said inner door sized to cover said recess when in a closed position;

an outer door hinged to close over said inner door and including a heat sealing means mounted thereon;

a vacuum nozzle extending at least partially between said inner and outer doors, said nozzle in communication with said recess; and wherein said inner and outer doors cooperate to retain a flexible container therebetween and around said nozzle so that said nozzle is positioned for fluid communication with an inside of said container.

15. The system of claim 14 wherein said nozzle further comprises a generally hollow tubular member that provides a guided flowpath between a top surface of said inner door and said recess.

16. The system of claim 15 wherein said nozzle is attached to said top surface of said inner door, and at least a portion of said nozzle extends over said door.

17. The system of claim 16 further comprising a plurality of elastomeric seals attached to said doors to engage said flexible container around said nozzle.

18. The system of claim 14 further comprising a removable drip pan resting in said recess and in communication with said vacuum source wherein said drip pan is configured to receive fluids and particles withdrawn from said container through said nozzle.

19. The system of claim 18 wherein said drip pan is sized to closely fit inside the contours of said recess.

20. The system of claim 19 wherein said drip pan defines an upper vacuum port upstanding from the bottom of said pan, and said drip pan defines an annular wall surrounding said pan.

21. The system of claim 20 wherein said pan further defines a lower connection port for connection to said vacuum inlet port within said recess.

22. The system of claim 21 further comprising a sealing member on one of said lower connection port and said vacuum inlet port for ensuring a sealed connection between said connection port and said inlet port.

23. The system of claim 19 wherein the vertical height of said upper vacuum port is less than the vertical height of said annular wall.

24. The system of claim 14 wherein said housing further comprises a plastic bag roll and cutting assembly comprising:

a removable rod fixably attached to said base housing for holding a plastic bag roll; and a cutting tool slidably attached to said base housing for cutting a plastic bag from said bag roll.

25. The system of claim 24 wherein said cutting tool is removable from said base housing.

26. The system of claim 14 wherein said base housing further comprises a status display consisting of a series of lights informing a user of current said system operations.

27. The system of claim 14 further comprising a wall mounting assembly to fixably attach said base housing to a fixed object.

28. The system of claim 14 wherein the vacuum source further comprises:

an electric motor having a shaft;

a cylinder member mounted to said motor, said cylinder defining a cylindrical chamber;

a motor eccentric wheel connected to the shaft of said electric motor;

a pump piston, pivotally connected at a first end of said pump piston to said motor eccentric wheel;

a pump piston passageway defined within said pump piston to allow air flow into a bottom side of side pump piston and out a side of said pump piston; and means for directing air flow into said cavity chamber and through said pump piston passageway.

29. The system of claim 28 wherein said means for directing air flow further comprises at least one air break mounted to an end of said pump piston.

30. The system of claim 14 further comprising a pressure sensor mounted within said base and fluidly connected to said vacuum inlet port in said recess, said pressure sensor also in electrical communication with circuitry for controlling said motor and said heat sealing means.

31. The system of claim 30 wherein said pressure sensor further comprises:

a sensor housing forming a sensor chamber and defining an airflow inlet;

a pressure piston slidably mounted within said sensor chamber, a portion of said pressure piston carrying electrically conductive material;

a spring biasing said pressure piston toward said airflow inlet;

at least one terminal pin including conductive material extending into said chamber adjacent said airflow inlet; and wherein said pressure piston is movable against said spring upon a preset level of airflow received through said airflow inlet.

32. The system of claim 14 wherein said nozzle further comprises a bent tubular structure having reinforcing members extending along sides of said nozzle.

33. The system of claim 14 further comprising a canister interface for providing fluid communication between said vacuum source and a container located remotely from said base housing.

34. An apparatus for evacuating and sealing a plastic bag, said apparatus comprising:

a base housing;

a vacuum source mounted within said housing;

a removable drip pan resting in said base and in communication with said vacuum source;

a nozzle extending at least partially over said pan in communication with said vacuum source;

a pair of doors hingeably mounted to said base housing and surrounding said nozzle for engaging said bag when an opening of said bag is positioned around said nozzle; and a heating element mounted on one of said doors for heat-sealing said bag.

35. The apparatus of claim 34 further comprising an elongated vacuum recess defined in a top surface of said base housing, said vacuum recess having fluid connection to said vacuum source.

36. The apparatus of claim 35 wherein said vacuum recess further comprises a vacuum intake opening.

37. The apparatus of claim 35 wherein said vacuum recess is sized to accommodate said drip pan, and said drip pan further comprises a coupling extending downwardly therefrom for removable, sealed engagement with said vacuum intake opening.

38. The apparatus of claim 37 wherein said pair of doors further comprises a first door adapted to sealably cover said vacuum recess and drip pan.

39. The apparatus of claim 38 wherein said nozzle further comprises a flexible plastic, and said nozzle is mounted to an upper side of said first door, said nozzle communicating with an underside of said door and extending forwardly from said door.

40. The apparatus of claim 39 wherein said pair of doors further comprises a second door adapted to cover said first door and said nozzle, said second door configured to press said nozzle toward said first door and to downwardly press said first door over said recess.

41. The apparatus of claim 40 further comprising a plurality of elastomeric seals attached to said doors to engage said flexible container around said nozzle.

42. The apparatus of claim 41 wherein said drip pan defines an upper vacuum port upstanding from the bottom of said pan, and said drip pan defines an annular wall surrounding said pan.

43. The apparatus of claim 42 wherein the vertical height of said upper vacuum port is less than the vertical height of said annular wall.

44. The apparatus of claim 34 wherein said nozzle further comprises at least one reinforcing member extending from a side of said nozzle to reinforce said nozzle structure.

45. The apparatus of claim 34 wherein said housing further comprises a plastic bag roll and cutting assembly comprising:

a removable rod fixably attached to said base housing for holding a plastic bag roll; and a cutting tool slidably attached to said base housing for cutting a plastic bag from said plastic bag roll.

46. The apparatus of claim 45 wherein said cutting tool is removable from said base housing.

47. The apparatus of claim 34 wherein said base housing further comprises a status display consisting of a series of lights informing a user of current said system operations.

48. The apparatus of claim 34 further comprising a wall mounting assembly for fixably attaching said base housing to a fixed object.

49. The apparatus of claim 34 wherein the vacuum source further comprises:

an electric motor having a shaft;

a cylinder member mounted to said motor, said cylinder defining a cylindrical chamber;

a motor eccentric wheel connected to the shaft of said electric motor;

a pump piston, pivotally connected at a first end of said pump piston to said motor eccentric wheel;

a pump piston passageway defined within said pump piston to allow air flow into a bottom side of said pump piston and out a side of said pump piston; and means for directing air flow into said cavity chamber and through said pump piston passageway.

50. The apparatus of claim 49 wherein said means for directing air flow further comprises at least one air break mounted to an end of said pump piston.

51. The apparatus of claim 34 further comprising a pressure sensor mounted within said base fluidly connected to said vacuum inlet port in said recess, said pressure sensor also in electrical communication with circuitry for controlling said motor and said heat sealing means.

52. The apparatus of claim 51 wherein said pressure sensor further comprises:

a sensor housing forming a sensor chamber and defining an airflow inlet;

a pressure piston slidably mounted within said sensor chamber, a portion of said pressure piston carrying electrically conductive material;

a spring biasing said pressure piston toward said airflow inlet;

at least one terminal pin including conductive material extending into said chamber adjacent said airflow inlet; and wherein said pressure piston is movable against said spring upon a preset level of airflow received through said airflow inlet.

53. The apparatus of claim 34 further comprising an interface for providing fluid communication between said vacuum source and a container located remotely from said base housing.

54. A system for evacuating containers comprising:

a base housing;

a recess defined within said base housing, said recess defining a vacuum inlet port;

a vacuum source located within said base housing and in fluid communication with said inlet port;

a pair of jclamping doors hingeably mounted to said base housing, said doors configured to cover said recess and retain a flexible container therebetween;

vacuum nozzle means mounted to one of said clamping doors, wherein doors may cooperate to retain said flexible container around a portion of said nozzle while allowing said nozzle to be positioned for fluid communication with an inside of said container and isolate said container for ambient; and adaptor means removably connectable to said vacuum source, said adaptor means configured to attach to standard mason jar-type containers and lids of accessory containers having valve means mounted therein.

55. The system of claim 54 wherein said adaptor means further comprises:

an exterior casing defining a cup-like interior region and an annular lip around an opening of said interior region;

a generally annular rubber gasket mounted on an interior perimeter of said interior region adjacent said lip, said gasket having an annular flange extending radially inwardly and outwardly from said lip to define an annular gasket recess, said annular flange sized to receive the mouth of a standard mason jar;

a hollow vacuum pole extending downwardly from an upper portion of said interior region of said casing to allow airflow from said interior region of said casing to said exterior of said casing; and means for fluidly connecting vacuum pole to said vacuum source.

56. The system of claim 55 wherein said vacuum pole contacts a lid of said mason jar when said mouth of said jar is placed within said annular lip of said casing.

57. The system of claim 55 wherein said annular gasket recess is deformable to allow a substantially hermetic fit between said flange of said gasket and said mouth.

58. The system of claim 54 wherein said lid of accessory containers further comprises:

a central recess defined in said lid;

at least one central recess passageway located within said central recess able to sustain an air flow from an upper side of said canister lid to a lower side of said canister lid;

a piston assembly mounted for reciprocal movement within said central recess;

at least one piston passageway defined within said piston assembly capable of sustaining air flow through said piston assembly;

a piston pipe configured to retain said piston within said central recess; and a knob configured to rotate said piston assembly via said piston pipe to align said at least one central recess passageway and said at least one piston passageway to allow air to pass through said central recess and out of said container and lid.

59. The system of claim 58 further comprising a plate spring embracing said piston pipe at at first end and said knob at a second end wherein said plate spring biases said knob into a position such that said at least one piston passageway does not align with said at least one central recess passageway.

60. An evacuable lid and container combination comprising:

a container having an open mouth;

a lid adapted to cover said open mouth to define an enclosable chamber, said lid defining a central recess therewithin;

at least one central recess passageway located within said central recess able to sustain an air flow from an upper side of said canister lid to a lower side of said canister lid;

a piston assembly mounted for a reciprocal movement within said central recess;

at least one piston passageway defined within said piston assembly capable of sustaining air flow through said piston assembly;

a piston pipe configured to retain said piston within said central recess; and a knob configured to rotate said piston assembly via said piston pipe to align said at least one central recess passageway and said at least one piston passageway to allow air to pass through said central recess and out of said enclosable chamber.

61. The evacuable lid and container combination of claim 60 wherein said at least one central recess passageway comprises two central recess passageways.

62. The evacuable lid and container combination of claim 60 wherein said at least one piston passageway and comprises two piston passageways.

63. The evacuable lid and container combination of claim 60 wherein said at least one central recess passageway and said at least one piston passageway are matching.

64. The evacuable lid and container combination of claim 60 wherein said piston assembly comprises a piston ring and a rubber piston.

65. The evacuable lid and container combination of claim 64 wherein said rubber piston is made of elastomeric material.

66. The evacuable lid and container combination of claim 60 wherein said piston assembly is closely confined within said piston passageway by sidewalls of said passageway.

67. The evacuable lid and container combination of claim 60 wherein said piston assembly may move upwardly or downwardly within said central recess.

68. The evacuable lid and container combination of claim 60 wherein said piston assembly is cylindrical.

69. The evacuable lid and container combination of claim 60 wherein said piston assembly contains at least one tab extending upward from said piston assembly.

70. The evacuable lid and container combination of claim 60 wherein said knob contains at least one finger extending downwardly from said knob.

71. The evacuable lid and container combination of claim 70 wherein said at least one finger contacts said piston assembly.

72. The evacuable lid and container combination of claim 60 wherein said piston pipe contains at least one stop member to stop the rotation of said knob.

73. The evacuable lid and container combination of claim 60 further comprising a spring placing a rotary bias on said knob.

74. The evacuable lid and container combination of claim 73 wherein said rotary bias is in a counterclockwise direction.

75. The evacuable lid and container combination of claim 73 wherein said spring embraces said knob and said piston pipe.

76. An apparatus for evacuating a plastic bag, said apparatus comprising:

a base housing;

a vacuum source method within said base housing;

a recess defined in said base housing and in communication with said vacuum source;

a removable drip pan resting in said recess and configured to align with at least a portion of an open end of said bag; and at least one door hingeably mounted to said base housing and closable over said drip pan.

77. The apparatus of claim 76 wherein said drip pan defines a fluid-retaining area on a top portion thereof.

78. The apparatus of claim 76 wherein said at least one door is configured to engage said bag when an opening of said bag is aligned with said drip pan.

79. The apparatus of claim 76 further comprising a vacuum port in communication with said vacuum source.

80. The apparatus of claim 79 wherein said vacuum port upstands from a bottom of said recess.

81. The apparatus of claim 79 wherein said drip pan further defines a vacuum opening, said vacuum opening being engageable with said vacuum port.

82. The apparatus of claim 76 wherein said drip pan is in fluid communication with a vacuum inlet.

83. The apparatus of claim 76 further comprising a heating element mounted to said at least one door to interface with said base housing for heat-sealing said bag.

84. The apparatus of claim 76 wherein said recess is elongated in shape.

85. The apparatus of claim 84 wherein said drip pan comprises an outer periphery that is configured to closely fit within said recess.

86. The apparatus of claim 85 wherein said fluid-retaining area of said drip pan has an outline shape closely corresponding to that of said outer periphery.

87. The apparatus of claim 76 wherein said removable drip pan is made of a cleanable material.

88. The apparatus of claim 76 wherein said removable drip pan is replaceable.

89. The apparatus of claim 76 wherein said at least one door comprises a first door hinged to said base housing to cover said recess and to cooperate with said base housing to retain said bag therebetween when in a closed position, and a second door containing a heat sealing means thereon, said second door covering said first door when in a closed position.

90. A system for evacuating containers comprising:

a base housing;

a recess defined within said base housing, said recess defining a vacuum inlet;

a vacuum source located within said housing and in fluid communication with said inlet;

at least one door hinged to said base housing, said at least one door sized to cover said recess and to cooperate with said base housing to retain a flexible container therebetween when in a closed position, said at least one door containing a heat sealing means mounted thereon; and a removable drip pan resting in said recess and in communication with said vacuum source wherein said drip pan is configured to receive fluids and particles withdrawn from said flexible container.

91. The system of claim 90 wherein said at least one door comprises a first door hinged to said base housing to cover said recess and to cooperate with said base housing to retain said flexible container therebetween when in a closed position, and a second door containing a heat sealing means thereon, said second door covering said first when in a closed position.

92. The system of claim 90 wherein said drip pan is sized to closely fit within the contours of said recess.

93. The system of claim 92 wherein said drip pan defines an upper vacuum port upstanding from the bottom of said pan, and said drip pan defines an annular wall.

94. The system of claim 93 wherein said pan further defines a lower connection to said vacuum inlet.

95. The system of claim 94 further comprising a sealing member on one of said lower connection port and said vacuum inlet for ensuring a sealed connection between said connection port and said inlet.

96. The system of claim 95 wherein the vertical height of said upper vacuum port is less than the vertical height of said annular wall.

97. The system of claim 90 wherein said drip pan is replaceable.

98. The system of claim 90 wherein said drip pan is made of a cleanable material.

99. An apparatus for evacuating and sealing a plastic bag, said apparatus comprising:

a base housing;

a vacuum source mounted within said housing;

a removable drip pan resting in an upper portion of said base housing and in communication with said vacuum source; and at least one door hingeably mounted to said base housing wherein said at least one door cooperates with said base housing to retain said plastic bag when said at least one door is in a closed position.

100. The system of claim 99 wherein said drip pan is replaceable.

101. The system of claim 99 wherein said drip pan is made of a cleanable material.

102. The apparatus of claim 99 wherein the at least one door comprises an inner door hingeably mounted to said base to cooperate with said base housing to retain said plastic bag and to cover said removable drip pan when in a closed position, and an outer door hingeably attached to said base housing to cover said inner door when in a closed position.

103. A removable drip pan for vacuum-sealing apparatus containing a vacuum inlet mounted in a base, said removable drip pan comprising:

a fluid-retaining recess defined within said pan;

an annular wall surrounding at least said recess;

an upper vacuum port upstanding from the bottom of said pan and positioned within the area surrounded by said annular wall; and a lower connection in communication with said vacuum port, said lower connection defined on a bottom of said drip pan for providing removable fluid communication between said lower connection and said vacuum inlet.

104. The system of claim 103 wherein said drip pan is replaceable.

105. The system of clam 103 wherein said drip pan is made of a cleanable material.

106. An apparatus for evacuating and sealing a plastic bag, said apparatus comprising:

a base housing providing means to isolate an open end of said plastic bag from ambient air, said plastic bag holding an amount of liquid;

a vacuum source mounted within said housing to draw air from the interior of said plastic bag; and a removable drip pan resting in said base housing and in communication with said vacuum source to prevent said liquid from entering said vacuum source.

107. The apparatus of claim 106 wherein the means for isolating an open end of said plastic bag from ambient air comprises at least one door hingeably attached to said base.

108. The apparatus of claim 107 wherein the at least one door comprises a first door hingeably attached to said base housing to cooperate with said base housing to retain said plastic bag, and a second door hingeably attached to said base housing to isolate an open end of said plastic bag from ambient air.

109. An improved vacuum-sealing appliance of the type having a base housing; a vacuum source mounted within said base housing; means on said base housing for securing a flexible container, said container holding an amount of liquid; and a top-open recess for collecting a portion of said amount of liquid, wherein the improvement comprises a removable drip pan positionable within said recess for collecting said portion of said amount of liquid.

110. The improved vacuum-sealing appliance of claim 109 wherein said removable drip pan comprises:

a fluid-retaining recess defined within said drip pan;

an annular wall surrounding at least said recess;

an upper vacuum port upstanding from the bottom of said drip pan and positioned within the area surrounded by said annular wall; and a lower connection in communication with a vacuum inlet on said vacuum-sealing appliance, said lower connection defined on the bottom of said drip pan for providing removable fluid communication between said lower connection and said vacuum inlet.

111. The system of claim 109 wherein said drip pan is replaceable.

112. The system of claim 109 wherein said drip pan is made of a cleanable material.

113. An apparatus for evacuating a plastic bag, said apparatus comprising:

a base housing;

a vacuum source mounted within said base housing;

a recess defined in said base housing and in communication with said vacuum source;

a removable drip an resting in said recess; and at least one door hingeably mounted to said base housing and closable over said drip pan.

114. The apparatus of claim 113 wherein the at least one door comprises an inner door hingeably mounted to said base to cover said removable drip pan when in a closed position, and an outer door hingeably attached to said base housing to cover said inner door when in a closed position.

115. The apparatus of claim 114 further comprising a vacuum nozzle extending at least partially between said inner and outer doors, said nozzle in communication with said recess.

116. A valve assembly comprising:

a central recess chamber;

at least one central recess passageway defined within said central recess chamber, said at least one central recess passageway capable of sustaining an airflow between a lower side and an upper side of said valve assembly;

a piston assembly resting within said central recess chamber such that said piston assembly is able to rotate within said central recess chamber;

at least one piston assembly passageway capable of sustaining an airflow through said piston assembly;

a piston pipe adjacent said central recess chamber to hold said piston assembly within said central recess chamber; and a knob mounted rotatably to said valve assembly and adjacent said piston assembly such that rotation of said knob creates rotation in said piston assembly within said central recess chamber, resulting in alignment of said central recess passageway and said piston assembly passageway, creating an airflow through said central recess passageway and said piston assembly passageway.

117. The valve assembly of claim 116 further comprising a spring placing a rotary bias on said knob.

118. An appliance for evacuating a flexible container, said appliance comprising:

a base housing;

a vacuum source mounted within said base housing;

a recess defined in said base housing and in communication with said vacuum source;

a removable drip pan resting in said recess wherein said drip pan is made of a cleanable material; and at least one door hingeably mounted to said base housing and closable over said drip pan.

119. The appliance of claim 118 wherein said drip pan is replaceable.

120. An apparatus for evacuating and sealing a plastic bag, said apparatus comprising:

a base housing;

a vacuum source mounted within said base housing;

a removable, cleanable drip pan resting in said base and in communication with said vacuum source;

a nozzle extending at least partially over said drip pan in communication with said vacuum source;

a pair of doors hingeably mounted to said base housing and surrounding said nozzle for engaging said bag when an opening of said bag is positioned around said nozzle; and a heating element mounted on one of said doors for heat-sealing said bag.

* * * * *